US007496318B2

(12) United States Patent
Miura et al.

(10) Patent No.: US 7,496,318 B2
(45) Date of Patent: Feb. 24, 2009

(54) CHARGING DEVICE AND IMAGE FORMING APPARATUS

(75) Inventors: Hiroyuki Miura, Kanagawa (JP); Minoru Rokutan, Kanagawa (JP); Takanori Suga, Kanagawa (JP); Yukiko Oda, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 106 days.

(21) Appl. No.: 11/510,570

(22) Filed: Aug. 28, 2006

(65) Prior Publication Data

US 2007/0189790 A1 Aug. 16, 2007

(30) Foreign Application Priority Data

Feb. 15, 2006 (JP) ..... 2006-038262

(51) Int. Cl.
*G03G 15/02* (2006.01)

(52) U.S. Cl. ..... 399/176

(58) Field of Classification Search ..... 399/168, 399/174, 176, 50; 430/902; 361/225
See application file for complete search history.

(56) References Cited

U.S. PATENT DOCUMENTS 5,164,779 A * 11/1992 Araya et al. ..... 399/176
5,663,327 A * 9/1997 Tambo et al. ..... 540/139
6,977,022 B2 * 12/2005 Sato et al. ..... 399/176 X
2004/0247340 A1 * 12/2004 Miura et al. ..... 399/176
2004/0265007 A1 * 12/2004 Hara ..... 399/176

FOREIGN PATENT DOCUMENTS

JP A 63-149669 6/1988
JP A 2005-025008 1/2005

* cited by examiner

*Primary Examiner*—Sandra L Brase
(74) *Attorney, Agent, or Firm*—Oliff & Berridge, PLC

(57) ABSTRACT

The invention provides a charging device including a charging roll and a voltage application unit which is capable of applying to the charging roll a voltage in which an alternating current voltage is superimposed on a direct current voltage, the alternating current (Iac) which flows through the charging roll satisfying the following Equation (1), the charging roll satisfying the following conditions (a) to (c), and the charging roll contacting an image supporter to charge the image supporter:

$$Iac/I(\text{inflection}) \leqq 1.2 \qquad \text{Equation (1)}$$

(in the Equation (1), I (inflection) represents the flexion point of Iac)

(a) the fluctuation of the outside diameter is 0.1 mm or less (b) resistance (common logarithm) is 9.0 log·Ω or less (c) resistance variation (common logarithm) is 0.5 log·Ω or less.

14 Claims, 10 Drawing Sheets

CHARGING DEVICE AND IMAGE FORMING APPARATUS

BACKGROUND

1. Technical Field

The present invention relates to a charging device used for electrophotographic and electrostatic recording processes, and an image forming apparatus using the charging device.

2. Related Art

In image forming apparatuses using electrophotographic systems, a uniform charge is formed on an image supporter (photoreceptor), an electrostatic latent image is formed thereon using a laser beam in which an image signal is modulated, and the electrostatic latent image is developed into a toner image with charged toner. Subsequently, the toner image is electrostatically transferred to a recording medium directly or through an intermediate transfer body to obtain a desired transferred image.

As described above, in an image forming apparatus using an electrophotographic system, charging treatment is carried out to form a uniform charge on the image supporter. An example of the charging member for such charging treatment is a contact-type charging member. Such contact-type charging members have advantages in that they usually apply an smaller electric current and produce significantly smaller amounts of ozone as compared with non-contact type charging members such as corotrons or scorotrons.

Contact-type charging members comprise an electro-conductive support having formed thereon a layer of an electro-conductive elastic body. The charging member is abutted against a photoreceptor in an electrophotographic apparatus, and a predetermined voltage is applied between the charging member and the photoreceptor to apply a charging potential to the photoreceptor. In contact-type charging members, precise resistance control in the semiconductive region is indispensable for achieving both uniform charging ability for uniformly charging a photoreceptor and leak resistance which prevents the concentration of electric current at a pinhole (a minute defect such as a small diameter hole) generated on a photoreceptor. In contact-type charging members, charging rolls having a roll shape are widely used.

It is known that in electrophotographic apparatuses using a charging roll, the surface potential of a photoreceptor can be more uniformly charged by superimposing a peak-to-peak alternating voltage that is at least two times greater than a breakdown voltage on a direct current voltage.

Recently, there has been a demand for longer operating life in electrophotographic apparatuses. The operating life of electrophotographic apparatuses is limited in particular by the wear of photoreceptors. For reducing the wear of photoreceptors, it is necessary to enhance the strength of the photoreceptor surface against wear, or reduce stresses which accelerate the wear.

Examples of methods proposed for the former treatment include imparting wear resistance to the photoreceptor surface, and forming a surface layer having excellent wear resistance.

For the latter treatment, when a contact-type charging member is used for charging a photoreceptor surface, particularly when charging is carried out by superimposing of an alternating current voltage, a method to reduce the applied alternating current voltage (electric current) is suggested.

However, if a sufficient alternating current voltage is not applied, satisfactory uniform charging effect by the superimposing of the alternating current voltage cannot be achieved, which results in image defects such as density irregularity due to non-uniform charging.

SUMMARY

The present invention has been made in view of the above circumstances and provides a charging device comprising a charging roll and a voltage application unit which is capable of applying to the charging roll a voltage in which an alternating current voltage is superimposed on a direct current voltage, the alternating current (Iac) which flows through the charging roll satisfying the following Equation (1), and the charging roll satisfying the following conditions (a) to (c), and the charging roll contacting an image supporter to charge the image supporter:

$$Iac/I(\text{inflection}) \leqq 1.2 \qquad \text{Equation (1)}$$

(in the Formula (1), I (inflection) represents the flexion point of lac)

(a) the fluctuation of the outside diameter is 0.1 mm or less.

(b) resistance (common logarithm) is 9.0 log·Ω or less.

(c) resistance variation (common logarithm) is 0.5 log·Ω or less.

DETAILED DESCRIPTION

A charging device according to an exemplary embodiment of the present invention and an image forming apparatus using the same are described in detail below.

The charging device according to an exemplary embodiment of the invention comprises a charging roll and a voltage application unit which is capable of applying to the charging roll a voltage in which an alternating current voltage is superimposed on a direct current voltage, the charging roll contacting an image supporter to charge the image supporter, the alternating current (Iac) which flows through the charging roll satisfying the following Equation (1), the charging roll satisfying the following conditions (a) to (c).

$$Iac/I(\text{inflection}) \leqq 1.2 \qquad \text{Equation (1)}$$

(in the Equation (1), I(inflection) represents the flexion point of Iac)

(a) the fluctuation of the outside diameter is 0.1 mm or less.

(b) resistance (common logarithm) is 9.0 log·Ω or less.

(c) resistance variation (common logarithm) is 0.5 log·Ω or less.

Figure 1:
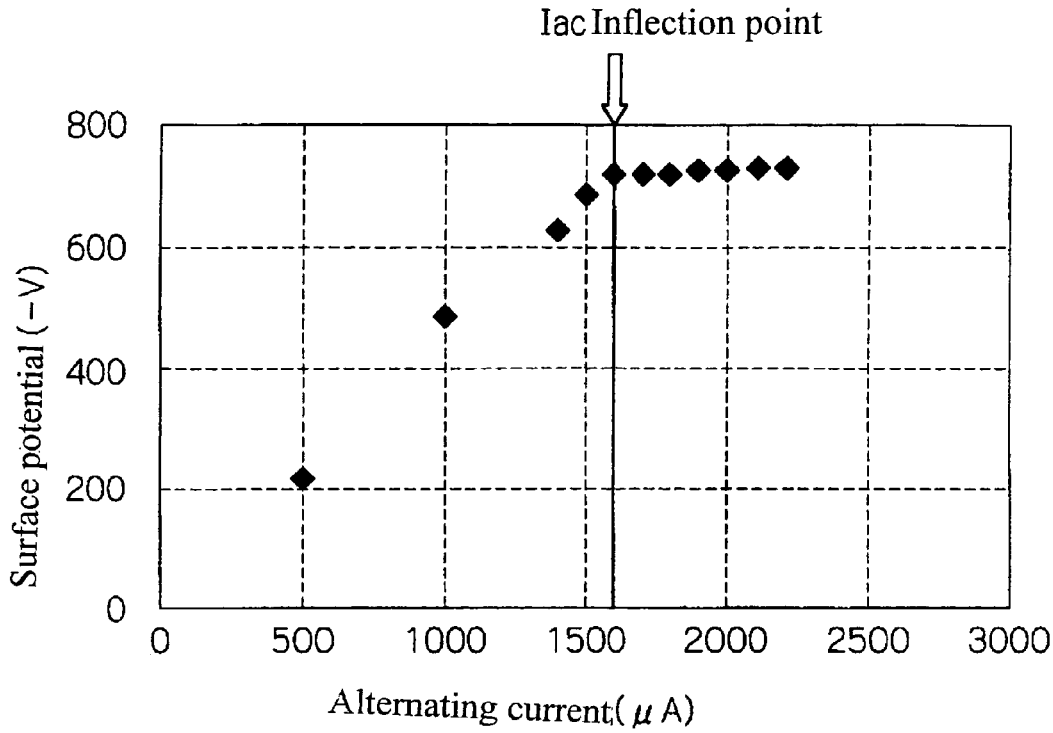
FIG. 1 shows the relationship between the surface potential (Vh) of an image supporter and the alternating current (Iac) which flows through a charging roll.

In the image forming apparatus using the charging roll, with the increase in alternating current voltage, the alternating current (Iac) which flows through the charging roll increases, and the surface potential (Vh) of the image supporter become constant at the flexion point (I (inflection)) of lac as shown in FIG. 1. Iac is usually used for charging an image supporter at a current value at the flexion point of lac with a surplus of several hundreds μA. If the alternating current which flows through the charging roll is used in the vicinity of the flexion point of lac, the uniform charging effect of the superimposition of alternating current voltage is not sufficiently achieved, thereby image defects such as density irregularity may occur due to ununiform charging.

However, for longer operating life of the image forming apparatus, the wear of an image supporter surface must be reduced by decreasing charging stresses, thus the alternating current flowing through the charging roll is desirably used in the vicinity of the flexion point of Iac.

According to the aspect of the invention, when the alternating current (Iac), which flows through the charging roll, satisfies the following Equation (1), the wear of an image supporter surface is effectively reduced, particularly in image forming apparatuses in which the image supporter is cleaned with a cleaning blade.

Furthermore, when the image supporter composing the image forming apparatus has a photosensitive layer containing hydroxygallium phthalocyanine (particularly hydroxygallium phthalocyanine which has diffraction peaks at Bragg angles (2θ±0.20) of 7.5° and 28.3° in an X ray diffraction spectrum using a CuKα characteristic X ray), the generation of white spots due to abnormal discharging, which is caused by various factors when the Equation (1) is satisfied, is inhibited.

In consideration of the uniform charging properties and the surface wear of an image supporter, lac preferably satisfies the following Equation (1'):$1.05 \leqq Iac/I(\text{inflection}) \leqq 1.15$.

Moreover, for charging an image supporter surface at a lower Iac, not only the resistance of the charging roll but also the resistance variation must be decreased, and the nip between the image supporter and the charging roll must be uniform. When the charging roll satisfies the conditions (a) to (c), uniform charging of the image supporter is achieved even when a lower alternating current (Iac) flows through the charging roll.

In the invention, the fluctuation of the outside diameter of the charging roll refers to the difference between the maximum and minimum outside diameters of the charging roll. More specifically, the outside diameter of the charging roll is measured at every 20 mm distance in the direction of the axis of the charging roll, and then the fluctuation of the outside diameter is determined from the maximum and minimum values. The outside diameter of the charging roll may be measured by a known method.

In the invention, the fluctuation of the outside diameter of the charging roll is preferably 0.05 mm or less, and more preferably 0.03 mm or less.

In the invention, the resistance (common logarithm) of the charging roll is, in consideration of the leak properties, preferably 6.0 to 8.5 log·Ω, and more preferably 7.0 to 8.0 log·Ω.

The resistance variation (common logarithm) of the charging roll is preferably 0.3 log·Ω or less, and more preferably 0.1 log·Ω or less.

The resistance of the charging roll refers to the average of the values measured by the method as described in Japanese Patent Application Laid-Open (JP-A) No. 6-118105. The average resistance value is determined, on the basis of the resistance values measured by the following method, from the arithmetic average of the measurements of the resistance at points 20 mm from each end of the rubber of the charging roll and three points in the center portion in the axial direction, and each six points in the circumferential direction of the above three points. In the invention, an electrode formed by a cylindrical SUS bearing having a width of 5 mm is in contact with the surface of the charging roll using a 25-g weight, and the resistance is measured between the electrode and an electro-conductive support with the charging roll is rotated at 5.5 rpm. As the power source and ammeter, a high resistance meter (trade name: R8340A digital high resistance/micro current meter: manufactured by Advantest Corporation) is used. The applied voltage is 100 V, and the common logarithm of the resistance is calculated from the following Equation (2).

$$\text{Common logarithm of the resistance } (\log\cdot\Omega) = \log_{10}(\text{applied voltage/electric current}) \qquad \text{Equation (2)}$$

The difference between the maximum and minimum resistances (common logarithm) of the charging roll measured as described above is used as the resistance variation (common logarithm).

Reduction of photoreceptor wear is carried out for extended operating life of the electrophotographic apparatus, and requires the protection of a charging roll surface from the contamination by toner, external additives or the like. For this purpose, the surface preferably satisfies the following conditions (d) and (e) for preventing the adhesion or embedding of the contaminants:

(d) the surface has a 10-point average roughness (Rz) of 5 μm or less.

(e) the surface has a dynamic ultra-microhardness in the range of 0.04 to 0.5.

In the invention, the 10-point average roughness (Rz) of the surface refers to the value measured, according to JISB0601-1994, the disclosure of which is incorporated herein by reference, using a surface roughness meter (trade name: Surfcom 1400A: manufactured by Tokyo Seimitu Co., Ltd.), in the axial direction of the roll, under conditions of a gauge length of 4.0 mm, a cutoff value of 0.8, and a measuring speed of 0.30 mm/sec. The dynamic ultra-microhardness refers to the hardness calculated from the following Equation (3) using a test load P(mN) and an indentation depth D (μm) when an indenter is pressed into a sample at a constant indentation speed (mN/s).

$$DH = \alpha \times P/D^2 \qquad \text{Equation (3)}$$

In the above Equation (3), a represents a constant depending on the shape of an indenter.

The dynamic ultra-microhardness is measured by a dynamic ultra-microhardness meter (trade name: DUH-W201S: manufactured by Shimadzu Co., Ltd.). The dynamic ultra-microhardness is determined by a soft material measurement in which an indentation depth D is measured when a triangular pyramid indenter (vertex angle: 115°, α: 3.8584) is pressed into the charging roll at an indentation speed of 0.14 mN/s, and a test load of 1.0 mN.

The 10-point average roughness (Rz) of the surface is more preferably 3.0 μm or less, and particularly preferably 2.0 μm or less. The dynamic ultra-microhardness of the surface is more preferably 0.04 to 0.2, and particularly preferably 0.05 to 0.15.

The alternating current voltage in the invention does not necessarily have to be applied under constant current control, but may be applied under constant voltage control as long as the Equation (1) is satisfied. The alternating current or voltage may be controlled according to the feedback from the monitoring of the flowing electric current or applied voltage, or the estimated variation in the electric current or voltage, and not particularly limited as long as the Equation (1) is satisfied.

The voltage application unit in the invention is not particularly limited as long as it has a power source capable of generating a voltage in which an alternating current voltage is superimposed on direct current voltage. The voltage application unit may comprise a power source, a detection unit which detects a voltage and/or an electric current applied to the charging roll by the power source, and a power control unit which controls the power source in such a manner that Equation (1) is satisfied on the basis of the voltage and/or electric current detected by the detection unit. When the voltage application unit has such configuration, the voltage can be readily controlled to satisfy Equation (1).

I (inflection) in the Equation (1) is a value determined by the combination of the charging roll and the image supporter, and may be varied with time. Thus, the voltage applied to the charging roll may be controlled according to the estimated variation in I(inflection) to satisfy the Equation (1). Alternatively, a detection unit for I(inflection) may be provided in the voltage application unit, wherein the voltage applied to the charging roll is controlled on the basis of the value of I(inflection) detected by the detection unit to satisfy the Equation (1).

Figure 2:
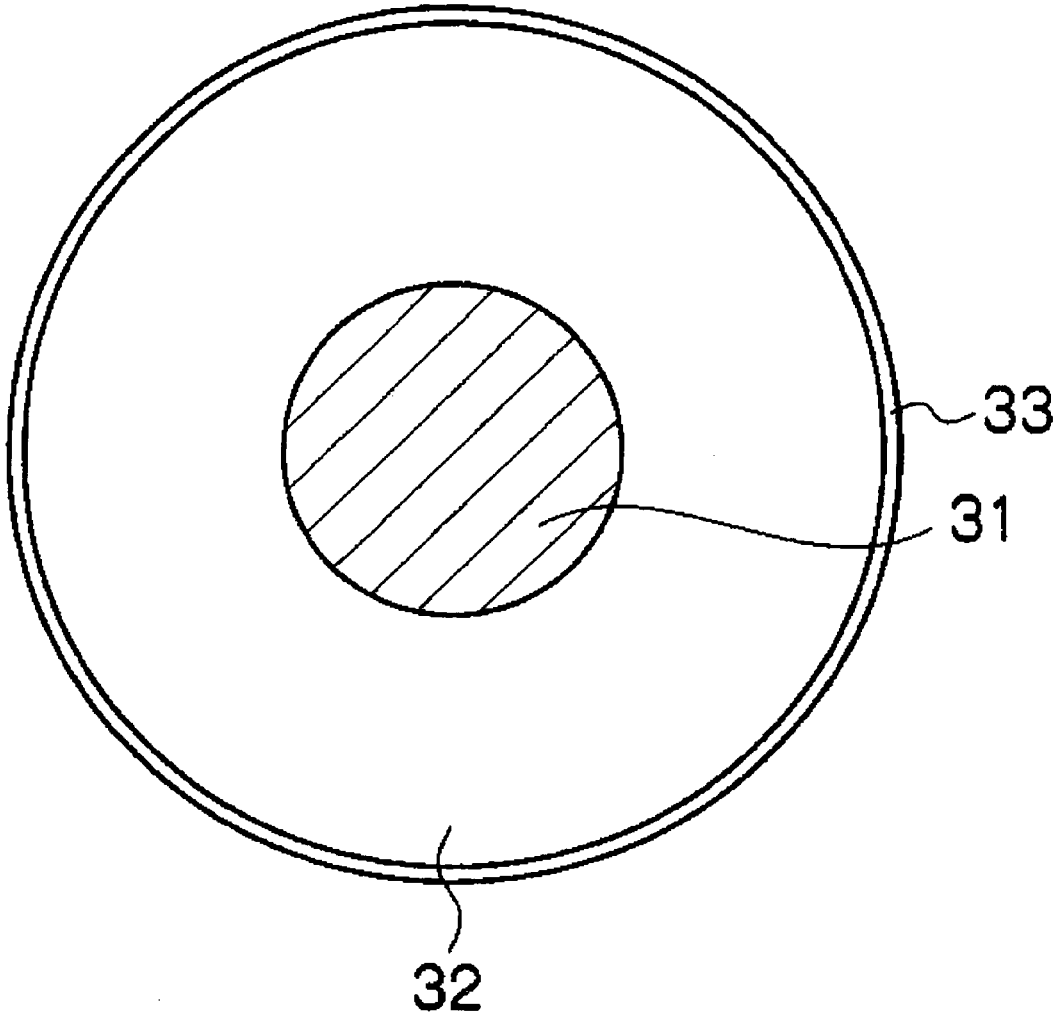
FIG. 2 shows the layer composition of a charging roll.
Figure 3:
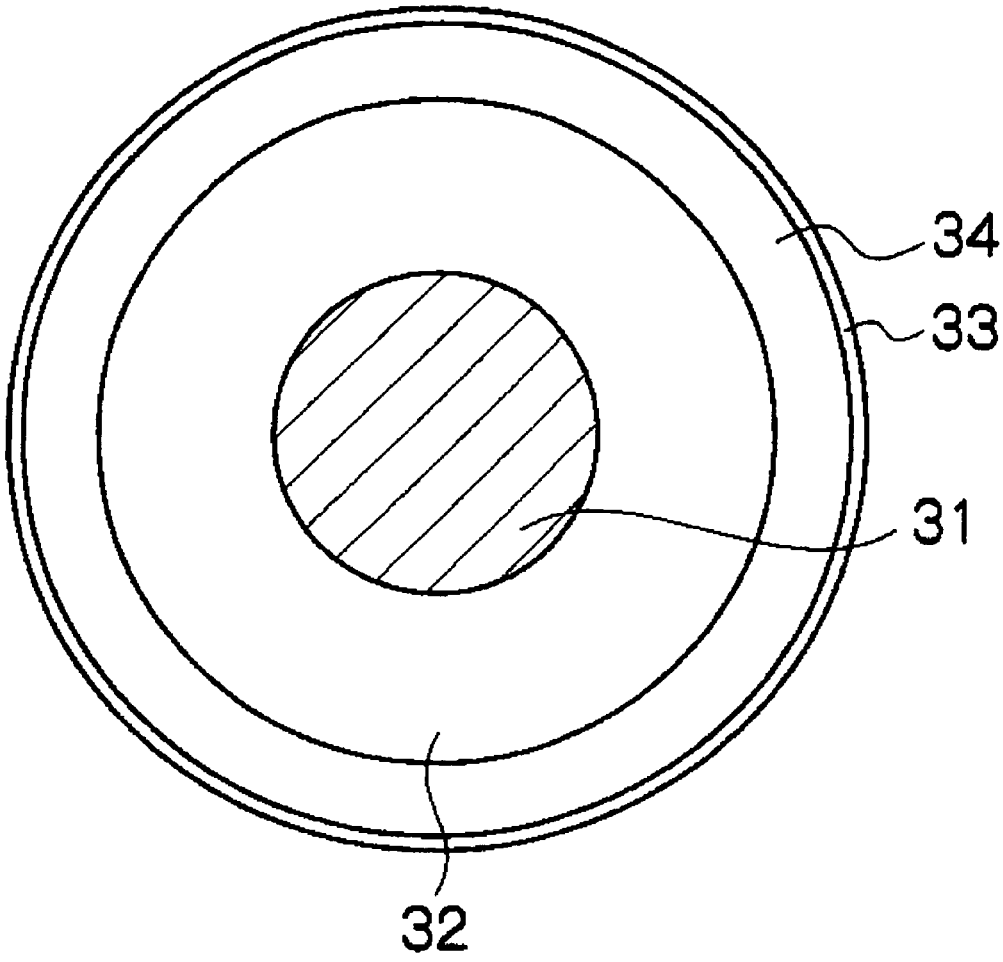
FIG. 3 shows the layer composition of a charging roll.

In the next, the charging roll used in the charging device according to an exemplary embodiment of the invention is further described. The charging roll is not limited to any particular configuration or material as long as it satisfies the conditions (a) to (c). The shape of the charging roll is appropriately selected from a straight shape, a crown shape and the like according to the pressing pressure on the image supporter or the hardness of the surface of the charging roll. The layer composition of the charging roll is not particularly limited. FIGS. 2 and 3 show exemplary embodiments of the layer composition of the charging roll. FIG. 2 shows a sectional view of a charging roll in which an electro-conductive elastic layer 32 and a surface layer 33 are sequentially formed on the surface of an electro-conductive support 31. FIG. 3 shows a sectional view of a charging roll in which an electro-conductive elastic layer 32, a resistance layer 34, and a surface layer 33 are sequentially formed on the surface of an electro-conductive support 31. As necessary, an adhesive may be used between the layers. The resistance layer 34 serves to secure the uniform charging ability and leak resistance.

The electro-conductive support serves as an electrode and a supporting member of the charging roll, and is composed of an electro-conductive material such as a metal or alloy of aluminum, copper alloy, stainless steel or the like; iron coated with chromium or nickel plating; an electro-conductive resin and the like. The diameter of the electro-conductive support is, for example, preferably 5 to 9 mm, and more preferably 6 to 8 mm.

The elastic layer and resistance layer are, for example, formed by dispersing an electro-conductive agent in a rubber material. Preferable examples of the rubber material include isoprene rubber, chloroprene rubber, epichlorohydrin rubber, butyl rubber, polyurethane, silicone rubber, fluorine rubber, styrene-butadiene rubber, butadiene rubber, nitrile rubber, ethylene propylene rubber, epichlorohydrin-ethylene oxide copolymer rubber, epichlorohydrin-ethylene oxide-allyl glycidyl ether copolymer rubber, ethylene-propylene-diene terpolymer copolymer rubber (EPDM), acrylonitrile-butadiene copolymer rubber (NBR), natural rubber, and blends thereof. Among these, polyurethane, silicone rubber, EPDM, epichlorohydrin-ethylene oxide copolymer rubber, epichlorohydrin-ethylene oxide-allyl glycidyl ether copolymer rubber, NBR, and blends thereof are preferably used. Particularly in the elastic layer, such a rubber material may be a foam or a nonfoam rubber.

As the electro-conductive agent, an electronic electro-conductive agent or an ionic electro-conductive agent may be used. Examples of the electronic electro-conductive agent include fine powder of: carbon black such as Ketjen Black and acetylene black; pyrolytic carbon, graphite; various kinds of electro-conductive metal or metal alloy such as aluminum, copper, nickel and stainless steel; various kinds of electro-conductive metal oxide such as tin oxide, indium oxide, titanium oxide, tin oxide-antimony oxide solid solution, and tin oxide-indium oxide solid solution; insulating materials having a surface treated by an electro-conductive process; and the like.

Furthermore, examples of the ionic electro-conductive agent include perchlorates or chlorates of tetraethylammonium, lauryltrimethyl ammonium and the like; perchlorates or chlorates of alkali metal such as lithium and magnesium, and alkali earth metal; and the like.

These electro-conductive agents may be used alone, or in combination of two or more kinds thereof.

Furthermore, the amount of addition thereof is not particularly limited. However, the amount of the electronic electro-conductive agent to be added is preferably 1 to 30 parts by weight, and more preferably 5 to 25 parts by weight with respect to 100 parts by weight of the rubber material. The amount of the ionic electro-conductive agent to be added is preferably in the range of 0.1 to 5.0 parts by weight, and more preferably in the range of 0.5 to 3.0 parts by weight with respect to 100 parts by weight of the rubber material.

The layer thickness of the elastic layer is preferably 1.0 to 4.0 mm, and more preferably 2.0 to 3.0 mm. The layer thickness of the resistance layer is preferably 200 to 1,000 μm, and more preferably 300 to 600 μm.

The polymer material which composes the surface layer is not particularly limited, and examples thereof include polyamide, polyurethane, polyvinylidene fluoride, ethylene tetrafluoride copolymer, polyester, polyimide, silicone resin, acrylic resin, polyvinyl butyral, ethylene tetrafluoroethylene copolymer, melamine resin, fluorine rubber, epoxy resin, polycarbonate, polyvinyl alcohol, cellulose, polyvinylidene chloride, polyvinyl chloride, polyethylene, and ethylene vinyl acetate copolymer.

The polymer materials may be used alone, or as a mixture or a copolymer of two or more kinds thereof. Furthermore, the number average molecular weight of the polymer material is preferably in the range of 1,000 to 100,000, and more preferably in the range of 10,000 to 50,000.

The surface layer is composed of the polymer material and an electro-conductive agent, which is those used as the electro-conductive agent for the elastic layer, or various particles. The amount of the electro-conductive agent to be added is not particularly limited, however preferably in the range of 1 to 50 parts by weight, and more preferably in the range of 5 to 20 parts by weight with respect to 100 parts by weight of the polymer material.

As the particles, fine polymer of metal oxides and composite metal oxides of silicon oxide, aluminum oxide, barium titanate and the like, and polymers such as tetrafluoroethylene, polyvinylidene fluoride and the like may be used alone or in combination thereof. However, the particles are not particularly limited thereto.

The layer thickness of the surface layer is preferably 1 to 50 μm, more preferably 3 to 20 μm.

The fluctuation of the outside diameter of the charging roll is significantly influenced by the accuracy of the layer thickness of the elastic layer.

The fluctuation of the outside diameter of the charging roll can be reduced to 0.1 mm or less by enhancing the accuracy of the elastic layer grinding and the accuracy of the mold for molding the elastic layer.

Furthermore, the resistance (common logarithm) of the charging roll can be reduced to 9.0 log·Ω or less by appropriately combining the constituents of the surface layer, the elastic layer, or the resistance layer. Examples of the preferable combination of a rubber material and an electro-conductive agent composing the elastic layer or the resistance layer include a rubber having either polarity, such as epichlorohydrin-ethylene oxide copolymer rubber, epichlorohydrin-ethylene oxide-allyl glycidyl ether copolymer rubber, acrylonitrile-butadiene copolymer rubber, and polyurethane, or a mixture of two or more kinds thereof, an ion electro-conductive agent; and carbon black. Examples of the preferable combination of a polymer compound and an electro-conductive agent composing the surface layer include a polymer compound such as polyamide, polyurethane, polyester, and melamine resin; and carbon black or a metal oxide.

The 10-point average roughness (Rz) of the surface of the charging roll can be reduced to 5 μm or less by, for example, adjusting the grinding conditions for the elastic layer, or adjusting the film thickness of or the forming conditions for the surface layer. The dynamic ultra-microhardness of the charging roll surface can be adjusted in the range of 0.04 to 0.5, for example, by adjusting both the material and the film thickness of the surface layer, and both the materials and the film thickness of the layer (elastic layer, resistance layer) which is inside from the surface layer.

The image forming apparatus of the invention comprises an image supporter (hereinafter, in the invention may be referred to as "electrophotographic photoreceptor" or simply "photoreceptor"), a charging device which charges the image supporter, a latent image forming device which forms a latent image on the charged surface of the image supporter, a developing device which develops the latent image formed on the surface of the image supporter into a toner image with toner, a transferring device which transfers the toner image formed on the surface of the image supporter to a transfer receiving body, and a cleaning device which removes residual toner from the surface of the image supporter after transferring of the toner image.

In the image forming apparatus according to an exemplary embodiment of the invention, the image supporter preferably has an electro-conductive substrate and a photosensitive layer containing hydroxygallium phthalocyanine provided on the electro-conductive substrate, and the hydroxygallium phthalocyanine preferably has diffraction peaks at Bragg angles (2θ±0.20) of 7.5° and 28.3° in an X ray diffraction spectrum using a CuKα characteristic X ray, thereby the generation of white spots due to abnormal discharging between the photoreceptor and the charging roll can be inhibited.

Hereinafter, the electrophotographic photoreceptor for used in the image forming apparatus according to an exemplary embodiment of the invention will be described in detail.

FIGS. 4 to 7 are schematic sectional views each showing an exemplary embodiment of the electrophotographic photoreceptor according to an exemplary embodiment of the invention, in which an electrophotographic photoreceptor 11 is cut at a plane perpendicular to the lamination direction of a substrate 12 and a photosensitive layer 13. The electrophotographic photoreceptors 11 as shown in FIGS. 4 to 7 are all separated-function type photoreceptors, and each photoreceptor comprises a photosensitive layer 13 having provided thereon an electric charge generating layer 15 and an electric charge transporting layer 16 separately.

Figure 4:
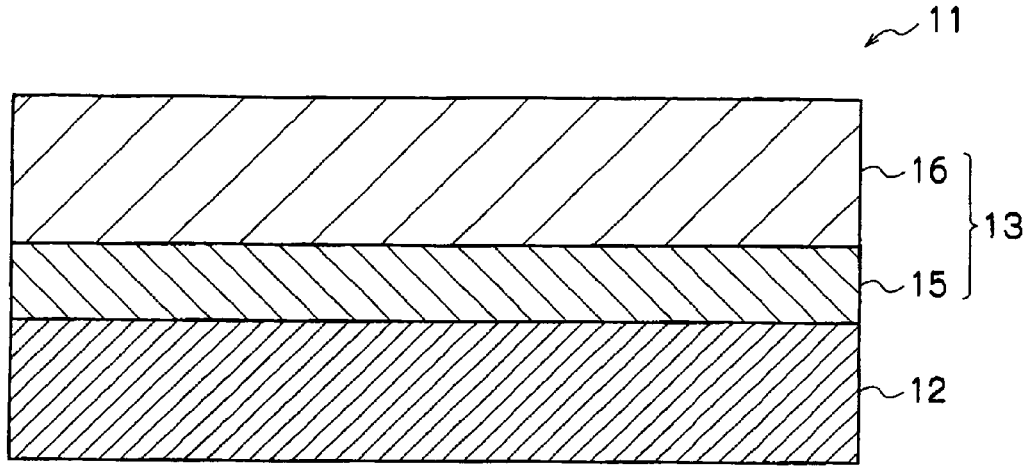
FIG. 4 is a schematic sectional view showing an exemplary embodiment of electrophotographic photoreceptor for use in an image forming apparatus according to an exemplary embodiment of the invention.
Figure 5:
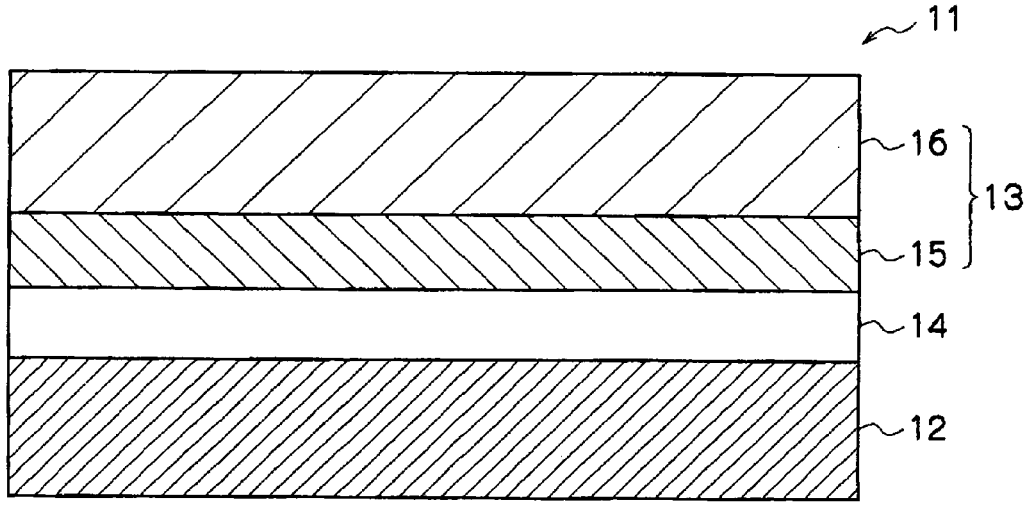
FIG. 5 is a schematic sectional view showing another exemplary embodiment of the electrophotographic photoreceptor for use in the image forming apparatus according to an exemplary embodiment of the invention.
Figure 6:
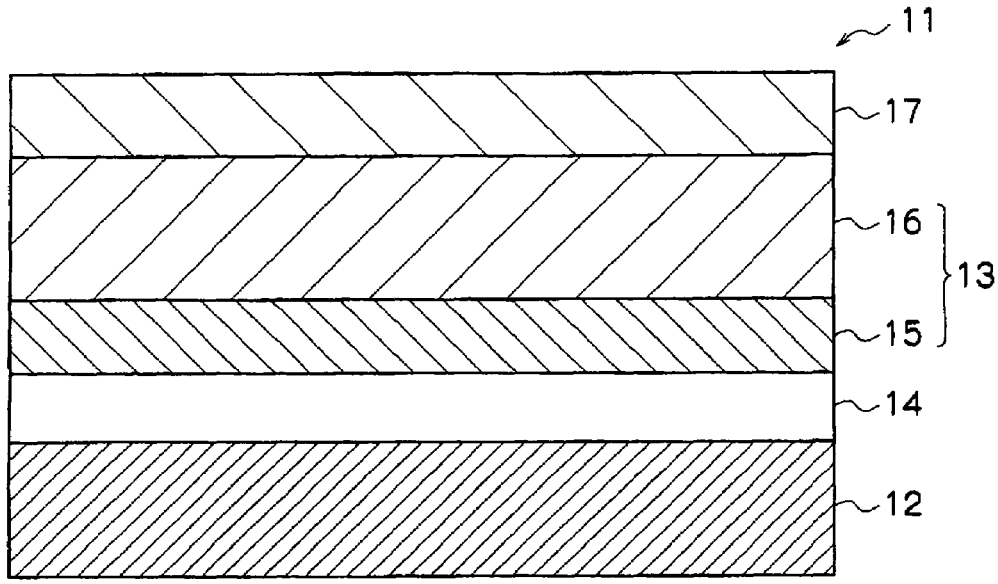
FIG. 6 is a schematic sectional view showing another exemplary embodiment of the electrophotographic photoreceptor for use in the image forming apparatus according to an exemplary embodiment of the invention.
Figure 7:
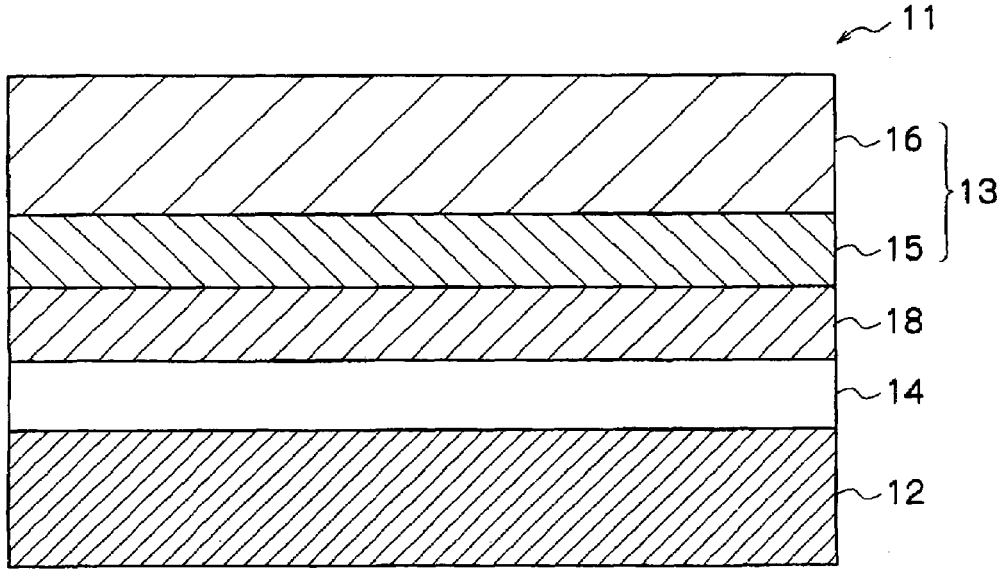
FIG. 7 is a schematic sectional view showing another exemplary embodiment of the electrophotographic photoreceptor for use in the image forming apparatus according to an exemplary embodiment of the invention.

More specifically, in the electrophotographic photoreceptor 11 as shown in FIG. 4, an electric charge generating layer 15 and an electric charge transporting layer 16 are laminated on an electro-conductive substrate 12 in this order to constitute a photosensitive layer 13. In the electrophotographic photoreceptor 11 as shown in FIG. 5, an undercoat layer 14, an electric charge generating layer 15, and an electric charge transporting layer 16 are laminated on an electro-conductive substrate 12 in this order to form a photosensitive layer 13. In the electrophotographic photoreceptor 11 as shown in FIG. 6, a undercoat layer 14, an electric charge generating layer 15, an electric charge transporting layer 16 and a protective layer 17 are laminated on an electro-conductive substrate 12 in this order to constitute a photosensitive layer 13. In the electrophotographic photoreceptor 11 as shown in FIG. 7, a undercoat layer 14, an intermediate layer 18, an electric charge generating layer 15, an electric charge transporting layer 16 are laminated on an electro-conductive substrate 12 in this order to constitute a photosensitive layer 13. Furthermore, though not described herein, the invention may be appropriately carried out in a single-layer type electrophotographic photoreceptor in which a photosensitive layer comprises a single layer containing both an electric charge-generating material and an electric charge-transporting material.

The constituents of the electrophotographic photoreceptor 11 are further described below.

Examples of the electro-conductive substrate 12 include a sheet of metal such as aluminum, copper, iron, zinc, and nickel; a substrate of paper, plastic, glass or the like deposited with metal such as aluminum, copper, gold, silver, platinum, palladium, titanium, nickel-chromium, stainless steel, and copper-indium; the substrate deposited with an electro-conductive metal compound such as indium oxide and tin oxide; the substrate laminated with metallic foil; and the substrate conductive-coated with a dispersion of carbon black, indium oxide, tin oxide- antimony oxide powder, metal powder, copper iodide or the like in a binding resin. The shape of the electro-conductive substrate 12 may be a drum, sheet, or plate form.

When a metallic pipe substrate is used as the electro-conductive substrate 12, the surface of the pipe substrate may be untreated, or roughened in advance by appropriate surface treatment. Such roughening can prevent moire density irregularities caused by interfering light which can be generated in the photoreceptor when a coherent light source such as laser beam is used as the exposure light source. Examples of the surface treatment include, mirror machining, etching, anodic oxidation, rough machining, centerless grinding, sandblast, and wet honing.

Examples of the material for use in the undercoat layer 14 include organic metal compounds such as: organic zirconium compounds such as zirconium chelate compounds, zirconium alkoxide compounds, and zirconium coupling agents; organic titanium compounds such as titanium chelate compounds, titanium alkoxide compounds, and titanate coupling agents; organic aluminum compounds such as aluminum chelate compounds and aluminum coupling agents; antimony alkoxide compounds; germanium alkoxide compounds; organic indium compounds such as indium alkoxide compounds and indium chelate compounds; organic manganese compounds such as manganese alkoxide compounds and manganese chelate compounds; organic tin compounds such as tin alkoxide compounds and tin chelate compounds; aluminum silicon alkoxide compounds; aluminum titanium alkoxide compounds; and aluminum zirconium alkoxide compounds. Among these, organic zirconium compounds, organic titanium compounds, and organic aluminum compounds are preferably used because they have a low residual potential and thereby exhibit favorable electrophotographic characteristics.

The undercoat layer 14 may contain a silane coupling agent such as vinyltrichlorosilane, vinyltrimethoxysilane, vinyltriethoxysilane, vinyltris-2-methoxyethoxysilane, vinyltriacetoxysilane, γ-glycidoxypropyltrimethoxysilane, γ-methacryloxypropyltrimethoxysilane, γ-aminopropyltriethoxysilane, γ-chloropropyltrimethoxysilane, γ-2-aminoethylaminopropyltrimethoxysilane, γ-mercaptopropyltrimethoxysilane, γ-ureidopropyltriethoxysilane, and β-3,4-epoxycyclohexyltrimethoxysilane. Furthermore, the layer also may contain a known binding resin such as polyvinyl alcohol, polyvinylmethylether, poly-N-vinylimidazole, polyethylenoxide, ethyl cellulose, methylcellulose, ethylene-acrylic acid copolymer, polyamide, polyimide, casein, gelatin, polyethylene, polyester, phenolic resin, vinyl chloride-vinyl acetate copolymer, epoxy resin, polyvinyl pyrrolidone, polyvinyl pyridine, polyurethane, polyglutamic acid, and polyacrylic acid. The mixing ratio between them can be appropriately selected as need.

In the invention, the undercoat layer 14 may contain metal oxide particles. The metal oxide particles can be optionally selected from known metal oxides as long as they can achieve desired characteristics of an electrophotographic photoreceptor, however one or more types of metal oxide particles selected from tin oxide, titanium oxide, and zinc oxide are preferably used. Such metal oxide particles are more preferably coated with at least one or more types of coupling agents. As the coupling agent, a silane coupling agent is more preferable.

In the undercoat layer 14, an electron transporting pigment may be mixed and dispersed. Examples of the electron transporting pigment include organic pigments such as perylene pigments, bisbenzimidazole perylene pigments, polycyclic quinone pigments, indigo pigments, and quinacridone pigments, organic pigments having an electron-attracting substituent such as a cyano group, a nitro group, a nitroso group, or a halogen atom, such as bisazo pigments and phthalocyanine pigments, and inorganic pigments such as zinc oxide and titanium oxide. Among these pigments, perylene pigments, bisbenzimidazole perylene pigments, and polycyclic quinone pigments are preferably used because they have high electron transfer properties. If the content of the electron transporting pigment is too large, the strength of the undercoat layer is deteriorated, which will result in defects in the coating film. Thus, the electron transporting pigment is used at 95% by weight or less, and preferably 90% by weight or less.

The undercoat layer 14 may contain metal oxide particles attached with an acceptor compound. As the acceptor compound, any compounds, which can achieve desired characteristics, may be used, and compounds having a quinone group are preferably used. Furthermore, acceptor compounds having an anthraquinone structure are preferably used. Examples of the compound having an anthraquinone structure include anthraquinone, hydroxy anthraquinone-based compounds, aminoanthraquinone-based compound, and aminohydroxyanthraquinone-based compounds. Specifically, anthraquinone, alizarin, quinizarin, anthrarufin, purpurin and the like are preferably used.

The amount of these acceptor compounds to be added is optionally selected in a range which achieves desired characteristics, but preferably 0.01 to 20% by weight, and more preferably 0.05 to 10% by weight with respect to the metal oxide. If the amount is 0.01% by weight or less, adequate acceptor properties to contribute to the improvement of the electric charge accumulation in the undercoat layer cannot be provided, thereby the deterioration of maintainability such as the increase in residual potential tends to be caused in repeated use. On the other hand, if the amount is 20% by weight or more, aggregation between metal oxide particles happens, thus the metal oxide cannot form a favorable electro-conductive channel in the undercoat layer during the formation of the undercoat layer, thereby the deterioration of maintainability such as the increase in residual potential, as well as image quality defects such as black spots tends to be caused in repeated use.

The acceptor compound is uniformly applied to metal oxide particles by adding dropwise a solution of an acceptor compound in an organic solvent or spraying the solution together with dry air or nitrogen gas to metal oxide particles while stirring with a mixer having a high shearing force. The addition or spraying of the solution is preferably carried out at a temperature lower than the boiling point of the solvent. If the solution is sprayed at a temperature higher than the boiling point, the solvent evaporates before the solution is uniformly stirred, thereby the acceptor compound tends to locally solidify to cause a failure in uniform treatment. After the addition or spraying the solution, it may be dried at a temperature higher than the boiling point of the solvent. Alternatively, the acceptor compound is uniformly applied to metal oxide particles as follows: metal oxide particles are stirred and dispersed in a solvent with an ultrasonic wave, a sand mill, an attritor, a ball mill or the like, and a solution of an acceptor compound in an organic solvent is added to the particles. The mixture is heated to reflux, or stirred or dispersed at a temperature lower than the boiling point of the organic solvent, and thereafter, the solvent is removed. The solvent is removed by filtration, or evaporated by distillation or heated-air drying.

Metal oxide particles attached with an acceptor compound requires powder resistance of about $10^2$ to $10^{11}$ Ω·cm. This is because the undercoat layer 14 requires adequate resistance for obtaining leak resistance.

The undercoat layer 14 is formed by applying a coating solution, in which the above-described materials are mixed and dispersed in a predetermined organic solvent, onto the substrate 12, and removing the solvent by drying. For mixing and dispersing the coating solution for the undercoat layer, a ball mill, a roll mill, a sand mill, an attritor, an ultrasonic wave, and the like may be used. As the organic solvent, any solvents which dissolve the organic metal compound and resins, and do not cause gelation or aggregation during mixing or dispersing the electron transporting pigment may be used. Specific examples thereof include methanol, ethanol, n-propanol, n-butanol, benzyl alcohol, methyl cellosolve, ethyl cellosolve, acetone, methyl ethyl ketone(MEK), cyclohexanone, methyl acetate, n-butyl acetate, dioxane, tetrahydrofuran, methylene chloride, chloroform, chlorobenzene, and toluene, and they may be used alone or in combination of two or more kinds thereof. The coating solution is dried by evaporating the solvent at a temperature which can form a film. When the thus obtained undercoat layer 14 contains no metal oxide particle, the thickness of the layer is preferably 0.1 to 10 μm, and more preferably 0.5 to 5.0 μm. When the layer contains metal oxide particles, the thickness of the layer is preferably exceeding 15 μm, and more preferably 15 to 50 μm. When the film thickness of the undercoat layer 14 satisfies the above-described conditions, local dielectric breakdown (photoreceptor leak) in an electrophotographic photoreceptor can be more securely prevented. Furthermore, stable characteristics are achieved in a long-term continuous use.

Examples of the material used in the intermediate layer 18 include, as in the materials used in the undercoat layer 14, organic metal compounds such as organic zirconium compounds such as zirconium chelate compounds, zirconium alkoxide compounds, and zirconium coupling agents; organic titanium compounds such as titanium chelate compounds, titanium alkoxide compounds, and titanate coupling agents; organic aluminum compounds such as aluminum chelate compounds and aluminum coupling agents; antimony alkoxide compounds; germanium alkoxide compounds; organic indium compounds such as indium alkoxide compounds and indium chelate compounds; organic manganese compounds such as manganese alkoxide compounds and manganese chelate compounds; organic tin compounds such as tin alkoxide compounds and tin chelate compounds; aluminum silicon alkoxide compounds; aluminum titanium alkoxide compounds; and aluminum zirconium alkoxide compounds. Among these, organic zirconium compounds, organic titanium compounds, and organic aluminum compounds are preferably used because they have a low residual potential and thereby exhibit favorable electrophotographic characteristics.

Furthermore, in the same manner with the above undercoat layer 14, the intermediate layer 18 may contain a silane coupling agent such as vinyltrichlorosilane, vinyltrimethoxysilane, vinyltriethoxysilane, vinyltris-2-methoxyethoxysilane, vinyltriacetoxysilane, γ-glycidoxypropyltrimethoxysilane, γ-methacryloxypropyltrimethoxysilane, γ-aminopropyltriethoxysilane, γ-chloropropyltrimethoxysilane, γ-2-aminoethylaminopropyltrimethoxysilane, γ-mercaptopropyltrimethoxysilane, γ-ureidopropyltriethoxysilane, and β-3,4-epoxycyclohexyltrimethoxysilane. Furthermore, the layer may also contain a known binding resin such as polyvinyl alcohol, polyvinylmethylether, poly-N-vinylimidazole, polyethylenoxide, ethyl cellulose, methylcellulose, ethylene-acrylic acid copolymer, polyamide, polyimide, casein, gelatin, polyethylene, polyester, phenolic resin, vinyl chloride-vinyl acetate copolymer, epoxy resin, polyvinyl pyrrolidone, polyvinyl pyridine, polyurethane, polyglutamic acid, and polyacrylic acid. The mixing ratio between them can be appropriately selected as need.

In the same manner with the above undercoat layer 14, an electron transporting pigment may be mixed and dispersed in the intermediate layer 18. Examples of the electron transporting pigment include organic pigments such as perylene pigments, bisbenzimidazole perylene pigments, polycyclic quinone pigments, indigo pigments, and quinacridone pigments, organic pigments having an electron-attracting substituent such as a cyano group, a nitro group, a nitroso group, or a halogen atom, such as bisazo pigments and phthalocyanine pigments, and inorganic pigments such as zinc oxide and titanium oxide. Among these pigments, perylene pigments, bisbenzimidazole perylene pigments, and polycyclic quinone pigments are preferably used because they have high electron transfer properties. If the content of the electron transporting pigment is excessive, the strength of the intermediate layer is deteriorated, which will result in defects in the coating film. Thus, the electron transporting pigment is used at 95% by weight or less, and preferably 90% by weight or less.

In the same manner with the undercoat layer 14, the intermediate layer 18 is formed by applying a coating solution, in which the above-described materials are mixed and dispersed in a predetermined organic solvent, onto the substrate 12, and removing the solvent by drying. For mixing and dispersing the coating solution for the undercoat layer, a ball mill, a roll mill, a sand mill, an attritor, and an ultrasonic wave may be used. As the organic solvent, any solvents, which dissolve organic metal compounds, resins and the like, and do not cause gelation or aggregation during mixing or dispersion of electron transporting pigments, may be used. Specific examples thereof include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene, and they may be used alone or in combination of two or more kinds thereof. The coating solution is dried by evaporating the solvent at a temperature which can form a film. The thickness of the thus obtained intermediate layer 18 is preferably 0.1 to 10 μm, and more preferably 0.5 to 5 μm. When the film thickness of the intermediate layer 18 satisfies the above-described conditions, stable characteristics of an electrophotographic photoreceptor can be achieved even in a long-term continuous use.

The electric charge generating layer 15 preferably contains a hydroxygallium phthalocyanine pigment from the viewpoint of achieving uniform charging properties in the charging device according to an exemplary embodiment of the invention. The hydroxygallium phthalocyanine used for a coating solution for forming electric charge generating layer may be any hydroxygallium phthalocyanine which achieves desired characteristics, and those having diffraction peaks at Bragg angles (2θ±0.2°) of 7.5° and 28.3° in an X ray diffraction spectrum using a CuKα characteristic X ray are preferably used.

The hydroxygallium phthalocyanine pigment is dispersed and retained in a predetermined binding resin, and composes the electric charge generating layer 15. The binding resin can be selected from a wide range of insulating resins. Preferable examples of the binding resin include insulating resins such as polyvinyl acetal resin, polyarylate resin, polycarbonate resin, polyester resin, phenoxy resin, vinyl chloride-vinyl acetate copolymer, polyamide resin, acrylic resin, polyacrylamide resin, polyvinyl pyridine resin, cellulose resin, urethane resin, epoxy resin, casein, polyvinyl alcohol resin, polyvinyl pyrrolidone resin, and organic photo-conductive polymers such as poly-N-vinyl carbazole, polyvinyl anthracene, polyvinyl pyrene, and polysilane. Among these, polyvinyl acetal resin and vinyl chloride-vinyl acetate copolymer are preferably used. These binding resins may be used alone or in combination of two or more kinds thereof. The mixing ratio (weight ratio) between the electric charge generating substance and the binding resin is preferably in the range of 10:1 to 1:10, and more preferably in the range of 8:2 to 3:7.

The formation of the electric charge generating layer 15 uses a coating solution in which the above-described hydroxygallium phthalocyanine pigment is dispersed in a solution of the binding resin in a predetermined organic solvent. Examples of the organic solvent for the coating solution for electric charge generating layer include those capable of dissolve binding resins, such as alcohol-based, aromatic, hydrocarbon halide-based, ketone-based, ketone alcohol-based, ether-based, and ester-based solvents. Specific examples thereof include methanol, ethanol, n-propanol, iso-propanol, n-butanol, benzyl alcohol, methyl cellosolve, ethyl cellosolve, acetone, methylethylketone, cyclohexanone, methyl acetate, ethyl acetate, n-butyl acetate, dioxane, tetrahydrofuran, methylene chloride, chloroform, chlorobenzene, toluene, xylene, dimethylformamide, dimethyl acetamide, and water. These solvents may be used alone or in combination of two or more kinds thereof. For dispersing the hydroxygallium phthalocyanine pigment in a binding resin solution, a ball mill, a roll mill, a sand mill, an attritor, and an ultrasonic wave may be used.

The hydroxygallium phthalocyanine pigment may be surface-treated for improving the dispersibility of the pigment in the hydroxygallium phthalocyanine dispersion. As the surface treatment agent, coupling agents may be used, but not limited thereto. Examples of the coupling agent include silane coupling agents such as vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxy silane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethylmethoxysilane, N,N-bis(β-hydroxyethyl)-γ-aminopropyltriethoxysilane, and γ-chloropropyltrimethoxysilane. Among these, vinyltriethoxysilane, vinyltris(2-methoxyethoxysilane), 3-methacryloxypropyltrimethoxysilane, 3-glycidoxypropyltrimethoxysilane, 2-(3,4-epoxycyclohexyl) ethyltrimethoxysilane, N-2-(aminoethyl)-3-aminopropyltrimethoxysilane, N-2-(aminoethyl)-3-aminopropylmethyldimethoxysilane, 3-aminopropyltriethoxysilane, N-phenyl-3-aminopropyltrimethoxysilane, 3-mercaptopropyltrimethoxysilane, and 3-chloropropyltrimethoxysilane are preferable.

In addition to the coupling agents, organic zirconium compounds such as zirconium butoxide, zirconium ethyl acetoacetate, zirconium triethanolamine, acetyl acetonate zirconium butoxide, ethyl acetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, and isostearate zirconium butoxide may be added. Furthermore, organic titanium compounds such as tetraisopropyl titanate, tetranormal-butyl titanate, butyl titanate dimer, tetra (2-ethylhexyl)titanate, titanium acetyl acetonate, polytitanium acetyl acetonate, titanium octylene glycollate, titanium lactate ammonium salt, titanium lactate, titanium lactate ethyl ester, titanium triethanolaminate, and polyhydroxy titanium stearate, and organic aluminum compounds such as aluminum isopropylate, monobutoxy aluminum diisopropylate, aluminum butylate, diethyl acetoacetate aluminum diisopropylate, and aluminum tris(ethylacetoacetate) may be added.

The coating solution for electric charge generating layer obtained by the above method can be used for various applications such as electrophotographic photoreceptors, optical disks, solar batteries, sensors, and non-linear optical materials.

The coating solution for electric charge generating layer may be centrifuged after dispersion. The centrifugation allows to efficiently remove wear debris of a dispersion vessel or dispersion media trapped during dispersion of the coating solution, and poorly dispersed coarse particles from the coating solution.

The electric charge generating layer 15 can be formed by applying the above coating solution for electric charge generating layer by blade coating, wire bar coating, spray coating, dip coating, bead coating, air knife coating, curtain coating, or the like, followed by drying the solution.

The film thickness of the thus obtained electric charge generating layer 15 is preferably 0.05 to 5 μm, more preferably 0.1 to 1 μm to provide good electric characteristics and image quality. If the thickness of the electric charge generating layer 15 is less than 0.05 μm, satisfactory sensitivity cannot be achieved. On the other hand, if the thickness of the electric charge generating layer 15 exceeds 5 μm, adverse effects such as poor charging properties tend to be produced.

The electric charge transporting layer 16 comprises a charge transporting substance and a binding resin. Specific examples of the charge transporting substance include hole transporting substances such as oxadiazole derivatives such as 2,5-bis(p-diethylaminophenyl)-1,3,4-oxadiazole, pyrazoline derivatives such as 1,3,5-triphenylpyrazoline and 1-[pyridyl-(2)]-3-(p-diethylaminostyryl)5-(p-diethylaminostyryl) pyrazoline, aromatic tertiary amino compounds such as triphenylamine, tri(p-methyl)phenylamine, N,N'-bis(3,4-dimethylphenyl)biphenyl-4-amine, dibenzylaniline, and 9,9-dimethyl-N,N'-di(p-tolyl)fluorenone-2-amine, aromatic tertiary di amino compounds such as N,N'-diphenyl N,N'-bis(3-methylphenyl)-[1,1'-biphenyl]-4,4'-diamine, 1,2,4-triazine derivatives such as 3-(4'-dimethylaminophenyl)-5,6-di-(4'-methoxyphenyl)-1,2,4-triazine, hydrazone derivatives such as 4-diethylaminobenzaldehyde-1,1-diphenylhydrazone, 4-diphenylaminobenzaldehyde-1,1-diphenylhydrazone, and [p-(diethylamino)phenyl]-(1-naphthyl)-phenylhydrazone, quinazoline derivatives such as 2-phenyl-4-styrylquinazoline, benzofuran derivatives such as 6-hydroxy-2,3-di(p-methoxyphenyl)benzofuran, α-stilbene derivatives such as p-(2,2-diphenylvinyl)-N,N'-diphenylaniline, enamine derivatives, carbazole derivatives such as N-ethyl carbazole, and poly-N-vinyl carbazole and derivatives thereof. Furthermore, electron transporting substances such as quinone-based compounds such as cloranil, bromoanil, and anthraquinone, tetracyanoquinodimethane-based compounds, fluorenone compounds such as 2,4,7-trinitrofluorenone and 2,4,5,7-tetranitro-9-fluorenone, oxadiazole-based compounds such as 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazol, xanthone-based compounds, thiophene compounds, and diphenoquinone compounds such as 3,3',5,5'-tetra-t-butyldiphenoquinone also may be used. Furthermore, polymers having a group composed of the above compound in the main chain or the side chain also may be used. These charge transporting substances may be used alone or in combination of two or more kinds thereof.

The binding resin of the electric charge transporting layer 16 is preferably a resin capable of forming an electric insulating film. Examples of such a resin include polycarbonate resin, polyarylate resin, polyester resin, methacrylic resin, acrylic resin, polyvinyl chloride resin, polyvinylidene chloride resin, polystyrene resin, polyvinyl acetate resin, styrene-butadiene copolymer, vinylidene chloride-acrylonitrile copolymer, vinyl chloride-vinyl acetate copolymer, vinyl chloride-vinyl acetate-maleic anhydride copolymer, silicon resin, silicon-alkyd resin, phenol-formaldehyde resin, styrene-alkyd resin, poly-N-carbazole, polyvinyl butyral, polyvinyl formal, polysulfone, casein, gelatin, polyvinyl alcohol, ethyl cellulose, phenolic resin, polyamide, carboxy-methyl cellulose, vinylidene chloride-based polymer wax, and polyurethane. These binding resins may be used alone or in combination of two or more kinds thereof. The mixing ratio (weight ratio) between the binding resin and the charge transporting substance may be optionally selected in consideraton of deterioration of electric characteristics and film strength.

The electric charge transporting layer 16 is formed by applying the coating solution for electric charge transporting layer containing the above-described materials onto the electric charge generating layer 15, and drying. The solvent for use in the coating solution may be optionally selected from known organic solvents which achieve desired characteristics of an electrophotographic photoreceptor. Preferable examples thereof include dioxane, tetrahydrofuran, methylene chloride, chloroform, chlorobenzene, and toluene. They may be used alone or in combination of two or more kinds thereof. The thickness of the electric charge transporting layer 16 is preferably 5 to 50 μm, and more preferably 10 to 40 μm.

For the purposes of preventing the deterioration of a photoreceptor caused by ozone or an oxidized gas generated in the image forming apparatus, or light or heat, additives such as an antioxidant or a photostabilizer may be added to the photosensitive layer of the electric charge transporting layer 16.

Examples of the antioxidant include hindered phenol, hindered amine, paraphenylene diamine, arylalkane, hydroquinone, spirochromane, spiroindanone and derivatives thereof, organosulfur compounds, and organophosphorous compounds.

Examples of the phenolic antioxidant include 2,6-di-t-butyl-4-methylphenol, styrenated phenol, n-octadecy-3-(3',5'-di-t-butyl-4'-hydroxyphenyl)-propionate, 2,2'-methyl enebis-(4-methyl-6-t-butylphenol), 2-t-butyl-6-(3'-t-butyl-5'-methyl-2'-hydroxybenzyl)-4-methylphenyl acrylate, 4,4'-butylidene-bis-(3-methyl-6-t-butylphenol), 4,4'-thio-bis-(3-methyl-6-t-butylphenol), 1,3,5-tris(4-t-butyl-3-hydroxy-2,6-dimethylbenzyl)isocyanurate, tetrakis-[methylene-3-(3',5',-di-t-butyl-4'-hydroxy phenyl)propionate]methane, and 3,9-bis[2-[3-(3-t-butyl-4-hydroxy-5-methylphenyl) propionyloxy]-1,1-dimethylethyl]-2,4,8,10-tetraoxaspiro[5,5]undecane.

Examples of the hindered amine-based compounds include bis(2,2,6,6-tetramethyl-4-piperidyl)sebacate, bis(1,2,2,6,6-pentamethyl-4-piperidyl)sebacate, 1-[2-[3-(3,5-di-t-butyl-4-hydroxyphenyl)propionyloxy]ethyl]-4-[3-(3,5-di-t-butyl-4-hydroxyphenyl)propionyloxy]-2,2,6,6-tetramethylpiperidine, 8-benzyl-7,7,9,9-tetramethyl-3-octyl-1,3,8-triazaspiro[4,5]undecane-2,4-dione, 4-benzoyloxy-2,2,6,6-tetramethylpiperidine, dimethyl succinate-1-(2-hydroxyethyl)-4-hydroxy-2,2,6,6-tetramethylpiperidine polycondensate, poly[{6-(1,1,3,3-tetramethylbutyl)imino-1,3,5-triazine-2,4-diyl}{(2,2,6,6-tetramethyl-4-piperidyl) imino}hexamethylene{(2,3,6,6-tetramethyl-4-piperidyl) imino}], 2-(3,5-di-t-butyl-4-hydroxy benzyl)-2-n-butyl malonic acid bis(1,2,2,6,6-pentamethyl-4-piperidyl), and N,N'-bis(3-aminopropyl)ethylenediamine-2,4-bis[N-butyl-N-(1,2,2,6,6-pentamethyl-4-piperidyl)amino]-6-chloro-1,3,5-triazine condensate.

Examples of the organosulfur antioxidant include dilauryl-3,3'-thiodipropionate, dimyristyl-3,3'-thiodipropionate, distearyl-3,3'-thiodipropionate, pentaerythritol-tetrakis-(β-laurylthiopropionate), ditridecyl-3,3'-thiodipropionate, and 2-mercaptobenzimidazole. Examples of the organophosphorous antioxidant include trisnonylphenyl phosphite, triphenyl phosphite, and tris(2,4-di-t-butylphenyl)-phosphite.

The organosulfur and organophosphorus antioxidants are called secondary antioxidants, and can achieve a synergistic effect when combined with a primary antioxidant such as phenolic or amine-based antioxidants.

Examples of the photostabilizer include benzophenone-based, benzotriazole-based, dithiocarbamate-based, and tetramethylpiperidine-based derivatives.

Examples of the benzophenone-based photostabilizer include 2-hydroxy-4-methoxybenzophenone, 2-hydroxy-4-octoxybenzophenone, and 2,2'-dihydroxy-4-methoxy benzophenone.

Examples of the benzotriazole-based photostabilizer include 2-(2'-hydroxy-5'-methylphenyl)-benzotriazole, 2-[2'-hydroxy-3'-(3",4",5',6"-tetrahydrophthalimido-methyl)-5'-methylphenyl]benzotriazole, 2-(2'-hydroxy-3'-t-butyl-5'-methylphenyl)-5-chlorobenzotriazole, 2-(2'-hydroxy-3'-t-butyl-5'-methylphenyl)-5-chlorobenzotriazole, 2-(2'-hydroxy-3',5'-di-t-butylphenyl)benzotriazole, 2-(2'-hydroxy-5'-t-octylphenyl)benzotriazole, and 2-(2'-hydroxy-3',5'-di-t-amylphenyl)benzotriazole.

Examples of the other compounds include 2,4-di-t-butylphenyl-3',5'-di-t-butyl-4'-hydroxybenzoate and nickel dibutyl-dithiocarbamate. Furthermore, at least one kind of electron-accepting substance may be contained for the purposes of improving the sensitivity, reducing the residual potential, reducing the fatigue during repeated use, and the like. Examples of the electron-accepting substance include succinic anhydride, maleic anhydride, dibromomaleic anhydride, phthalic anhydride, tetrabromo phthalic anhydride, tetracyanoethylene, tetracyanoquinodimethane, o-dinitrobenzene, m-dinitrobenzene, cloranilquinone, dinitroanthraquinone, trinitrofluorenone, picric acid, o-nitrobenzoic acid, p-nitrobenzoic acid, and phthalic acid. Among these, fluorenone-based and quinone-based benzene derivatives, and benzene derivatives having an electron-attractive substituent such as Cl—, CN—, and $NO_2$— are particularly preferable.

Furthermore, in the electric charge transporting layer 16, a solid lubricant or a metal oxide may be dispersed for the purpose of reducing wear. Examples of the solid lubricant include fluorine-containing resin particles (ethylene tetrafluoride, chlorotrifluoroethylene, tetrafluoroethylene propylene hexafluoride resin, vinyl fluoride resin, vinylidene fluoride resin, ethylene dichloride difluoride, and copolymers thereof), and silicon-containing resin particles. Examples of the metal oxide include silica, alumina, titanium oxide, and tin oxide. Dispersion of the solid lubricant reduces the coefficient of friction of the surface of the electric charge transporting layer, and thereby reduces the wear of the layer. Furthermore, dispersion of the metal oxide increases the mechanical hardness of the electric charge transporting layer, and thereby reduces the wear of the layer. As the fluorine-containing resin particles are hardly dispersible, a fluorine-containing polymer dispersing aid may be used for improving the dispersibility. For dispersing the above solid lubricant and metal oxide, a roll mill, a ball mill, a vibration ball mill, an attritor, a sand mill, a colloid mill, a paint shaker, a homogenizer, a high-pressure homogenizer may be used. For effective dispersion, the diameter of the particles to be dispersed is preferably 1.0 μm or less, more preferably 0.5 μm or less. Furthermore, a trace amount of silicone oil may be added as a leveling agent for improving the smoothness of the coated film In the electrophotographic photoreceptor of the invention, as shown in FIG. 6, the protective layer 17 may be formed as necessary. The surface protective layer 17 is preferably a cured film comprising the compound represented by the following formula (I).

$$F\text{-}[D\text{-}A]^{b} \quad (I)$$

In the formula (I), F represents an organic group derived from a photofunctional compound, D represents a divalent group, A represents a substituted silicon group having a hydrolyzable group and represented by $—SiR^{1}_{3-a}(OR^{2})_{a}$, b represents an integer of 1 to 4. Wherein, $R_1$ represents hydrogen, an alkyl group, or a substituted or unsubstituted aryl group, $R_2$ represents hydrogen, an alkyl group, or a trialkylsilyl group. a represents an interger of 1 to 3.

In the formula (I), A, or a substituted silicon group represented by $—SiR^{1}_{3-a}(OR^{2})_{a}$ and having a hydrolyzable group serves to form three-dimensional Si—O—Si bonds (inorganic glassy network) by crosslinking reaction.

Furthermore, in the formula (I), F represents an organic group having photoelectronic properties, more specifically photocarrier transporting properties, and may have the structure of photofunctional compounds which have been conventionally known as charge transporting substances. Specific examples of the organic group represented by F include compound skeletons having hole-transporting properties, such as triarylamine-based compounds, benzidine-based compounds, arylalkane-based compounds, aryl-substituted ethylene-based compounds, stilbene-based compounds, anthracene-based compounds, and hydrazone-based compounds, and compound skeletons having electron transporting properties, such as quinone-based compounds, fluorenone compounds, xanthone-based compounds, benzophenone-based compounds, cyanovinyl-based compounds, and ethylene-based compounds.

Preferable examples of the organic group represented by F include a group represented by the following formula (II). When F is the group represented by the formula (II), it exhibits particularly excellent photoelectronic properties and mechanical characteristics.

(II)

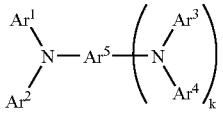

In the formula (II), $Ar^1$ to $Ar^4$ each represent a substituted or unsubstituted aryl group. $Ar^5$ represents a substituted or unsubstituted aryl group or an arylene group. b of $Ar^1$ to $Ar^4$ are combined with a group represented by $\text{-}D\text{-}SiR^{1}_{3-a}(OR^{2})_{a}$. k represents 0 or 1.

In the formula (II), $Ar^1$ to $Ar^4$ are preferably any of the group represented by the following formulae (II-1) to (II-7).

(II-1)

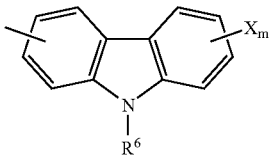

-continued (II-2)

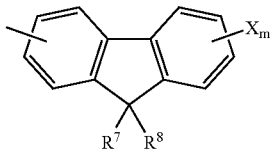

(II-3)

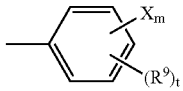

(II-4)

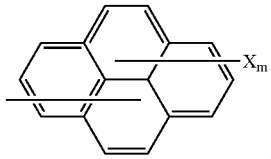

(II-5)

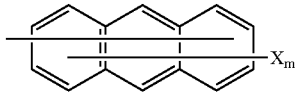

(II-6)

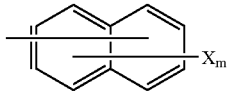

$$—Ar\text{-}Z's\text{-}Ar—X_m \quad (II\text{-}7)$$

In the formulae (II-1) to (II-7) , $R^6$ represents at least one selected from the group consisting of a hydrogen atom, an alkyl group having 1 to 4 carbon atoms, a phenyl group which is substituted with an alkyl group having 1 to 4 carbon atoms or an alkoxy group, an unsubstituted phenyl group and an aralkyl group having 7 to 10 carbon atoms, $R^7$ to $R^9$ each represent at least one selected from the group consisting of a hydrogen atom, an alkyl group having 1 to 4 carbon atoms, an alkoxy group having 1 to 4 carbon atoms, or a phenyl group which is substituted with an alkoxy group having 1 to 4 carbon atoms, an unsubstituted phenyl group, an aralkyl group having 7 to 10 carbon atoms, and a halogen atom, Ar represents a substituted or unsubstituted arylene group, X represents $\text{-}D\text{-}SiR^{1}_{3-a}(OR^{2})_{a}$ in the formula (I), m and s each represent 0 or 1, and t each represents an integer of 1 to 3.

Ar in the formula (II-7) is preferably a member represented by the following formulae (II-8) or (II-9).

(II-8)

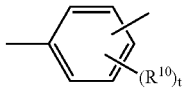

(II-9)

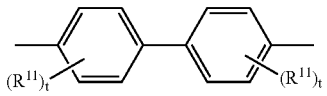

In the formulae (II-8) and (II-9), $R_{10}$ and $R_{11}$ each represent at least one selected from the group consisting of a hydrogen atom, an alkyl group having 1 to 4 carbon atoms, an alkoxy group having 1 to 4 carbon atoms, a phenyl group which is substituted with an alkoxy group having 1 to 4 carbon atoms, an unsubstituted phenyl group, an aralkyl group having 7 to 10 carbon atoms, and a halogen atom, t represents an integer of 1 to 3.

Z' in the formula (II-7) is preferably a member represented by any of the following formulae (II-10) to (II-17).

$$—(CH2)_q-$$ (II-10)

$$—(CH_2CH_2O)_r—$$ (II-11)

(II-12)

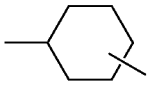

(II-13)

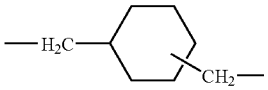

(II-14)

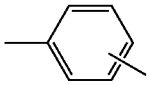

(II-15)

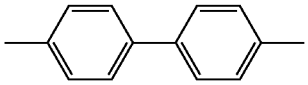

(II-16)

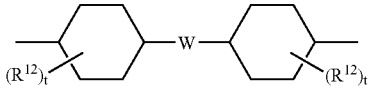

(II-17)

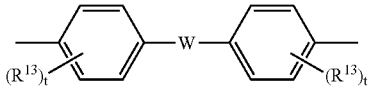

In the formulae, $R_{12}$ and $R_{13}$ each represent at least one selected from the group consisting of a hydrogen atom, an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and a halogen atom, W represents a divalent group, q and r each represent an integer of 1 to 10, and t each represents an integer of 1 to 3.

In the formulae (II-16) and (II-17), W is preferably any of the following divalent groups represented by the following structures of (II-18) to (II-26).

$$—CH_2—$$ (II-18)

$$—C(CH_3)_2—$$ (II-19)

$$—O—$$ (II-20)

$$—S—$$ (II-21)

$$—C(CF_3)_2—$$ (II-22)

$$—Si(CH_3)_2—$$ (II-23)

(II-24)

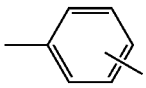

(II-25)

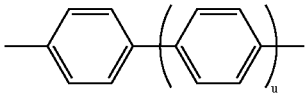

-continued (II-26)

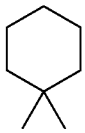

In the structures, u represents an integer of 0 to 3.

In the formula (II), when k is 0, $Ar_5$ is an aryl group exemplified for $Ar_1$ to $Ar_4$, and when k is 1, $Ar_5$ is an arylene group which is removed hydrogen atoms from the aryl group.

In the formula (I), the divalent group represented by D serves to combine F which impart photoelectronic properties with A which directly bonds to the three-dimensional inorganic glassy network, and also serves to impart adequate flexibility to the inorganic glassy network, which has hardness and on the contrary brittleness, to enhance the toughness of the network as a film. Specific examples of the divalent group represented by D include divalent hydrocarbon groups represented by $—C_nH_{2n}—$, $—C_nH_{2n-2}—$, or $—C_nH_{2n-4}—$ (n represents an integer of 1 to 15), —COO—, —S—, —O—, $—CH_2—C_6H_4—$, —N═CH—, $—C_6H_4—C_6H_4—$, and combinations thereof and substitution products thereof.

In the formula (I), b is preferably 2 or more. When b is 2 or more, the photofunctional organic silicon compound represented by the formula (I) has two or more Si atoms, thereby the inorganic glassy network is readily formed, and the mechanical strength tends to be enhanced. The compound represented by the formula (I) may be used alone or in combination of two or more kinds thereof.

Furthermore, together with the compound represented by the formula (I), the compound represented by the following formula (III) may be used for the purpose of further enhancing the mechanical strength of the cured film.

$$B\text{-}An$$ (III)

In the formula (III), A represents a substituted silicon group having a hydrolyzable group and represented by $—SiR^1_{3-a}(OR^2)_a$. Wherein, $R_1$, $R_2$, and a are the same for those of $R_1$, $R_2$, and a in the formula (I). B is at least one member or a combination of any two or more members selected from a bivalent or higher multi-valent hydrocarbon group which may be branched, a bivalent or higher multi-valent phenyl group, and —NH—. n represents an integer of 2 or more.

The compound represented by the formula (III) is a compound having a substituted silicon group which has a hydrolyzable group and is represented by A, or $—SiR^1_{3-a}(OR^2)_a$. The compound represented by the formula (III) forms a Si—O—Si bond to provide a three-dimensional crosslinked cured film through the reaction with the compound represented by the formula (I), or the compound represented by the formula (III). When the compound represented by the formula (III) is combined with the compound represented by the formula (I), the cured film tends to have a three-dimensional crosslinked structure and adequate flexibility, and thereby achieves higher mechanical strength. Table 1 summarizes preferable examples of the compound represented by the formula (III).

TABLE 1

| | |
|---|---|
| III-1 | $(MeO)_3Si$–$Si(OMe)_3$ |
| III-2 | $(EtO)_3Si$–$Si(OEt)_3$ |
| III-3 | $(i\text{-}Pr\text{-}O)_3Si$–$Si(O\text{-}i\text{-}Pr)_3$ |
| III-4 | $(MeO)_3Si$–$Si(OMe)_3$ |
| III-5 | $(EtO)_3Si$–$Si(OEt)_3$ |
| III-6 | $(i\text{-}Pr\text{-}O)_3Si$–$Si(O\text{-}i\text{-}Pr)_3$ |
| III-7 | $(MeO)_3Si$–$Si(OMe)_3$ |
| III-8 | $(EtO)_3Si$–$Si(OEt)_3$ |
| III-9 | $(MeO)_3Si$–$Si(OMe)_3$ |
| III-10 | $(EtO)_3Si$–$Si(OEt)_3$ |
| III-11 | $(MeO)_3Si$–$NH$–$Si(OMe)_3$ |
| III-12 | $(MeO)_3Si$–$NH$–$NH$–$Si(OMe)_3$ |
| III-13 | $(MeO)_2MeSi(CH_2)_2SiMe(OMe)_2$ |
| III-14 | $(EtO)_2EtSi(CH_2)_2SiEt(OEt)_2$ |
| III-15 | $(MeO)_2MeSi(CH_2)_6SiMe(OMe)_2$ |
| III-16 | $(EtO)_2EtSi(CH_2)_6SiEt(OEt)_2$ |
| III-17 | $(MeO)_2MeSi(CH_2)_{10}SiMe(OMe)_2$ |
| III-18 | $(EtO)_2EtSi(CH_2)_{10}SiEt(OEt)_2$ |
| III-19 | $MeOMe_2Si(CH_2)_6SiMe_2OMe$ |

The compound represented by the formula (1) may be used in combination with other compounds which are capable of crosslinking reaction. Examples of such compound include various silane coupling agents and commercial silicone-based hard coating agents.

Examples of the silane coupling agent include vinyltrichlorosilane, vinyltrimethoxysilane, vinyltriethoxysilane, γ-glycidoxypropylmethyldiethoxysilane, γ-glycidoxypropyltrimethoxysilane, γ-glycidoxypropyltrimethoxysilane, γ-aminopropyltriethoxysilane, γ-aminopropyltrimethoxysilane, γ-aminopropylmethyldimethoxysilane, N-β(aminoethyl)γ-aminopropyltriethoxysilane, tetramethoxysilane, methyltrimethoxysilane, and dimethyldimethoxysilane.

Examples of the commercial hard coating agent include KP-85, CR-39, X-12-2208, X-40-9740, X-4101007, KNS-5300, X-40-2239 (each manufactured by Shin-Etsu Chemical Co., Ltd.), AY42-440, AY42-441, and AY49-208 (each manufactured by Toray Dow Corning Silicone Co. Ltd.).

A fluorine-containing compound may be added to the protective layer 17 for the purpose of imparting surface lubricity. Enhancement of the surface lubricity decreases the coefficient of friction between the cleaning member, and improves the wear resistance. Moreover, the surface lubricity prevents the adhesion of discharge products, toner, and paper powder to the surface of a photoreceptor, which contributes to extend the operation life of the photoreceptor.

As the fluorine-containing compound, fluorine atom-containing polymer such as polytetrafluoroethylene may be added as it is, or the particles of such a polymer may be added. When a cured film is formed from the compound represented by the formula (I), the fluorine-containing compound is preferably a compound which is capable of reacting with alkoxysilane and constitutes a part of the crosslinked film. Examples of such a fluorine-containing compound include (tridecafluor-1,1,2,2-tetrahydrooctyl)triethoxysilane, (3,3,3-trifluoropropyl)trimethoxysilane, 3-(heptafluoroisopropoxy) propyltriethoxysilane, 1H,1H,2H,2H-perfluoroalkyltriethoxysilane, 1H,1H,2H,2H-perfluorodecyltriethoxysilane, and 1H,1H,2H,2H-perfluorooctyltriethoxysilane.

The content of the fluorine-containing compound is preferably 20% by weight or less with respect to the total weight of the protective layer 17. If the content of the fluorine-containing compound exceeds 20% by weight, the film-forming ability of the crosslinked cured film may be impaired.

The protective layer 17 containing the above compound has sufficient oxidation resistance, however, an antioxidant may be added for the purpose of imparting higher oxidation resistance. The antioxidant is preferably a hindered phenolic or hindered amine-based antioxidant, and known antioxidants such as organosulfur-based antioxidant, phosphite-based antioxidant, dithiocarbamate-based antioxidant, thiourea-based antioxidant, and benzimidazole-based antioxidant may be used. The content of the antioxidant is preferably 15% by weight or lower, and more preferably 10% by weight or lower with respect to the total weight of the protective layer 17.

Examples of the hindered phenolic antioxidant include 2,6-di-t-butyl-4-methylphenol, 2,5-di-t-butylhydroquinone, N,N'-hexamethylenebis(3,5-di-t-butyl-4-hydrxyhydro-cinnamamide, 3,5-di-t-butyl-4-hydroxybenzylphosphonate-diethylester, 2,4-bis[(octylthio)methyl]-o-cresol, 2,6-di-t-butyl-4-ethylphenol, 2,2'-methylenebis(4-methyl-6-t-butylphenol), 2,2'-methylenebis(4-ethyl-6-t-butylphenol), 4,4'-butylidenebis(3-methyl-6-t-butylphenol), 2,5-di-t-amylhydroquinone, 2-t-butyl-6-(3-butyl-2-hydroxy-5-methylbenzyl)-4-methylphenyl acrylate, and 4,4'-butylidene bis(3-methyl-6-t-butyl phenol).

Furthermore, other known additives used for forming coating film, such as a leveling agent, an ultraviolet absorbing agent, a photostabilizer, and a surfactant, may be added to the protective layer 17.

The protective layer 17 is formed by applying the coating solution containing the above-described compounds onto the electric charge transporting layer 16, and heating. The heating causes the three-dimensional crosslinking curing reaction of the compound represented by the formula (I), thus a strong cured film if formed. The heating temperature is not particularly limited unless the lower layer is affected, and preferably room temperature to 200° C., more preferably 100 to 160° C.

The crosslinking curing reaction may be carried out with no catalyst, or with an appropriate catalyst. Examples of the catalyst include acid catalysts such as hydrochloric acid, sulfuric acid, phosphoric acid, formic acid, acetic acid, trifluoroacetic acid, bases such as ammonia and triethylamine, organic tin compounds such as dibutyltin diacetate, dibutyltin dioctoate, stannous octoate, and organic titanium compounds such as tetra-n-butyl titanate,tetraisopropyltitanate, and iron salts, manganese salts, cobalt salts, zinc salts, zirconium salts, and aluminum chelate compounds of organic carboxylic acids.

Furthermore, a solvent may be added to the coating solution as necessary in order to facilitate the application of the coating solution for the protective layer. Specific examples of the solvent include water, methanol, ethanol, n-propanol, i-propanol, n-butanol, benzylalcohol, methyl cellosolve, ethyl cellosolve, acetone, methyl ethyl ketone, cyclohexanone, methyl acetate, n-butyl acetate, dioxane, tetrahydrofuran, methylene chloride, chloroform, dimethyl ether, and dibutyl ether. These solvents may be used alone or in combination of two or more kinds thereof.

Examples of the method for applying the solution include blade coating, wire bar coating, spray coating, dip coating, bead coating, air knife coating, and curtain coating.

The film thickness of the thus formed protective layer 17 is preferably 0.5 to 20 μm, and more preferably 2 to 10 μm.

Next, the image forming apparatus according to an exemplary embodiment of the invention will be further described with reference to figures.

Figure 8:
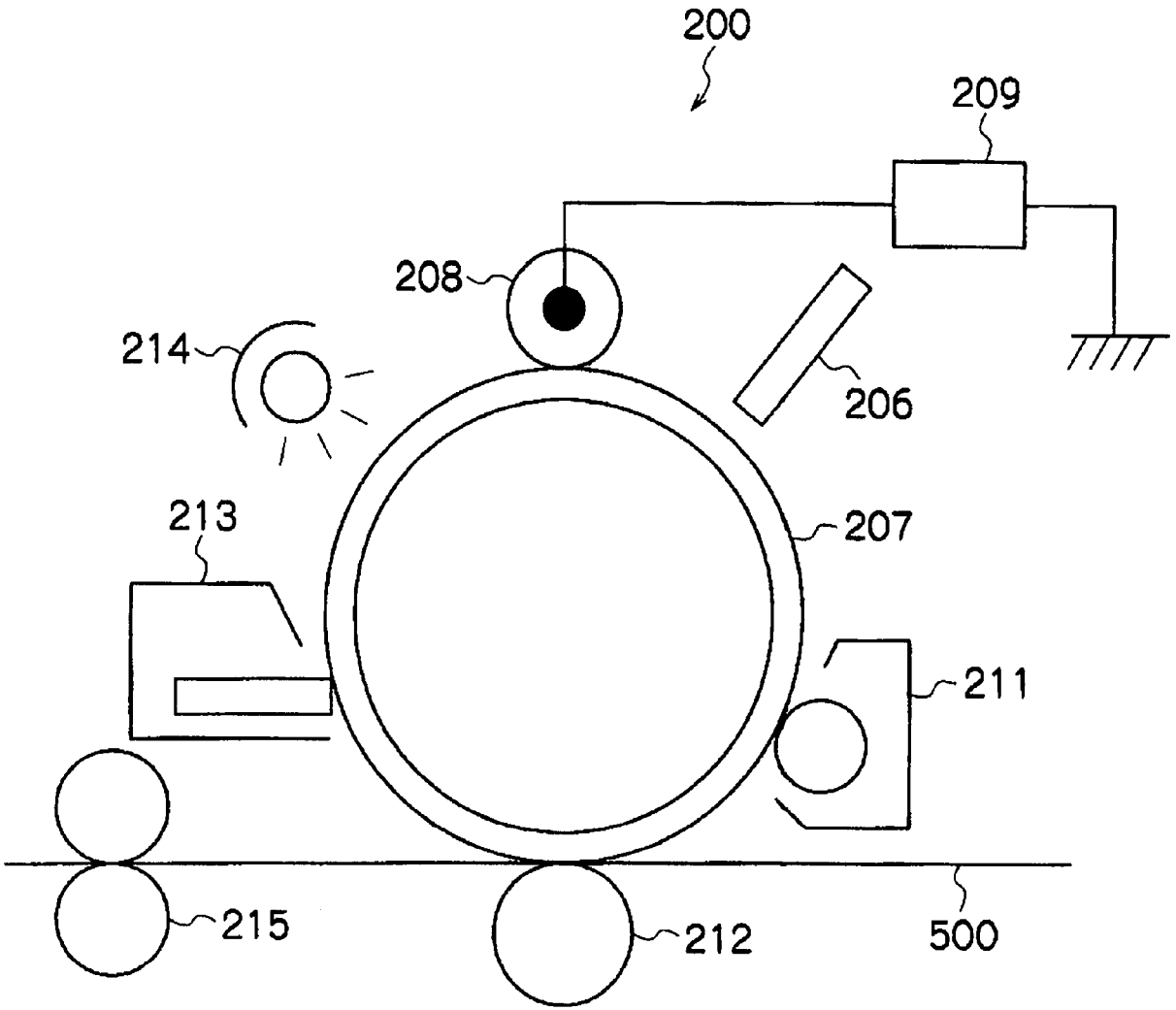
FIG. 8 is a schematic sectional view showing an image forming apparatus according to an exemplary embodiment of the invention.

FIG. 8 is a sectional view schematically showing the basic configuration of an image forming apparatus according to the first embodiment of the invention. As shown in FIG. 8, an image forming apparatus 200 comprises an electrophotographic photoreceptor 207, a charging device 208 which charges the electrophotographic photoreceptor 207, a power source 209 which is connected to the charging device 208, an exposure device 206 which exposes the electrophotographic photoreceptor 207 charged by the charging device 208 to form a latent image, a developing device 211 which develops the latent image formed by the exposure device 206 into a toner image with toner, a transferring device 212 which transfers the toner image formed by the developing device 211 to a transfer receiving body (image output medium) 500, a cleaning device 213, an eraser device 214, and a fixing device 215. The eraser device 214 may not be provided in some cases.

The developing device 211 provides toner to the electrophotographic photoreceptor 207. The photosensitive layer preferably contains the hydroxygallium phthalocyanine pigment, and, for example, may be any of the photosensitive layers as shown in FIGS. 4 to 7. The charging device 208 as shown in FIG. 8 charges the surface of the electrophotographic photoreceptor 207 by contacting an electro-conductive member (charging roll) with the surface of the photoreceptor 207, and it follows a charging system called "contact charging system", in which the charging device according to an exemplary embodiment of the invention is used.

As the exposure device 206, any optical device which can imagewisely expose the surface of the electrophotographic photoreceptor with a light source such as a semiconductor laser, a light-emitting diode (LED), or a liquid crystal shutter may be used.

The toner for use in the invention contains, for example, a binding resin and a coloring agent. Examples of the binding resin include homopolymers and copolymers of styrenes, monoolefins, vinyl esters, cc-methylene aliphatic monocarboxylic acid esters, vinyl ethers, vinyl ketones and the like, and typical examples of the binding resins include polystyrene, styrene-alkyl acrylate copolymer, styrene-alkyl methacrylate copolymer, styrene-acrylonitrile copolymer, styrene-butadiene copolymer, styrene-maleic anhydride copolymer, polyethylene, and polypropylene. Other examples include polyester, polyurethane, epoxy resin, silicone resin, polyamide, denatured rosin, paraffin wax and the like.

Examples of the typical coloring agents include magnetic powder such as magnetite and ferrite, carbon black, aniline blue, chalcoil blue, chromium yellow, ultramarine blue, Du Pont oil red, quinoline yellow, methylene blue chloride, phthalocyanine blue, malachite green oxalate, lamp black, rose bengal, C.I. pigment red 48:1, C.I. pigment red 122, C.I. pigment red 57:1, C.I. pigment yellow 97, C.I. pigment yellow 17, C.I. pigment blue 15:1, and C.I. pigment blue 15:3.

Known additives such as a charge control agent, a release agent, and other inorganic particles may be internally or externally added to the toner. Examples of the typical release agents include low-molecular polyethylene, low-molecular polypropylene, Fischer-Tropsch wax, montan wax, carnauba wax, rice wax, and candelilla wax.

As the charge control agent, known agents such as azo-based metal complex compounds, metal complex compounds of salicylic acid, and resin-type charge control agents or the like having a polar group may be used.

As other inorganic particles, small diameter inorganic particles having an average primary particle diameter of 40 nm or less may be used for the purpose of controlling powder mobility, charge control or the like, and as necessary, larger inorganic or organic particles may be used in combination for the purpose of reducing adherence. Such other inorganic particles may be known particles.

Furthermore, surface treatment of the small diameter inorganic particle is effective since it increases the dispersibility and powder mobility of the particles.

The toner for use in the invention is preferably manufactured by a polymerization such as an emulsion polymerization aggregation and a dissolution suspension from the viewpoint of high shape controllability. Furthermore, the toner obtained by the method may be used as the core of a core-shell toner in which aggregated particles are attached to each other, heated, and fused. When an external additive is added, the toner and the external additive can be mixed with a Henschel mixer, a V blender or the like. Furthermore, when the toner is manufactured by wet process, the external additive may be added by wet process.

The transferring device 212 is preferably capable of providing an electric current of a predetermined electric current density to the electrophotographic photoreceptor 207 when the toner image formed on the electrophotographic photoreceptor 207 is transferred to the transfer receiving body 500.

The cleaning device 213 removes residual toner applied to the surface of the electrophotographic photoreceptor after the transfer process. The thus cleaned electrophotographic photoreceptor is repeatedly used for the image forming process. As the cleaning device, a cleaning blade, as well as a cleaning brush, and a cleaning roll may be used. Among these, a cleaning blade is preferable. Examples of the material of the cleaning blade include urethane rubber, neoprene rubber, and silicone rubber.

Furthermore, the image forming apparatus may further comprise an erase beam irradiation device 214 as shown in FIG. 8. The device prevents a phenomenon of carry-over of the residual potential of the repeatedly used electrophotographic photoreceptor to the subsequent cycles, and thereby enhances the image quality.

Figure 9:
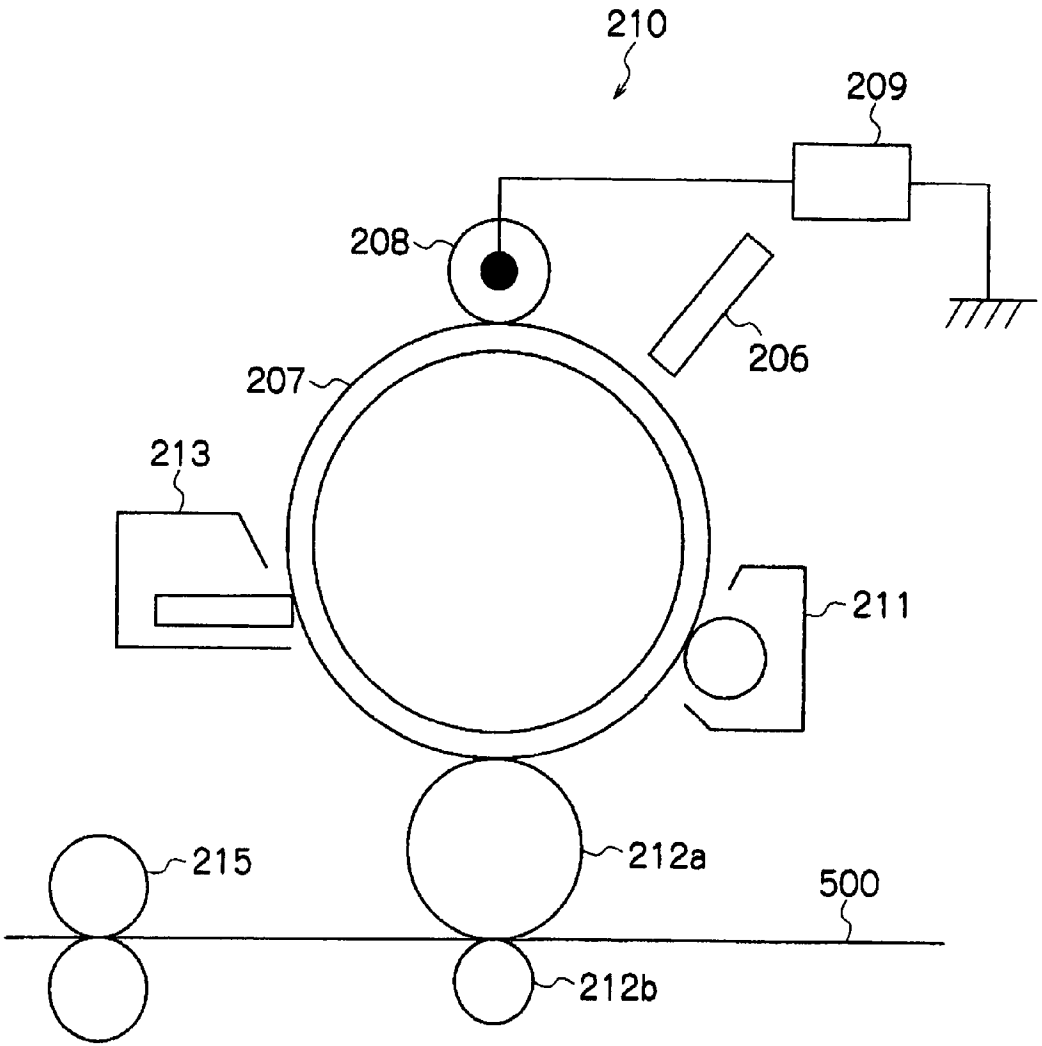
FIG. 9 is a schematic sectional view showing an image forming apparatus according to another exemplary embodiment of the invention.

FIG. 9 is a sectional view schematically showing the basic configuration of an image forming apparatus according to the second embodiment of the invention. As shown in FIG. 9, an image forming apparatus 210 comprises a transferring device of intermediate transfer system which transfers the toner image formed on the electrophotographic photoreceptor 207 to a primary transfer member 212*a*, and subsequently transfers the image to the transfer receiving body (image output medium) 500 provided between the primary transfer member 212*a* and a second transfer member 212*b*. During the transfer, the transfer device is capable of providing an electric current of the predetermined electric current density from the primary transfer member 212*a* to the electrophotographic photoreceptor. Although not shown in FIG. 9, the image forming apparatus 210 may further comprise an eraser device as in the same as the image forming apparatus 200 as shown in FIG. 8. The other constituents of the image forming apparatus 210 are the same as those of the image forming apparatus 200.

The image forming apparatus 210 is different from the image forming apparatus 200 in that it uses the intermediate transfer system as described above. However, as in the image forming apparatus 200 according to the first embodiment, the image forming apparatus 210 preferably combines the electrophotographic photoreceptor 207 having a photosensitive layer containing hydroxygallium phthalocyanine and the charging device of the invention for stably obtaining good image quality for the extended time.

Furthermore, the supply of an electric current of the predetermined electric current density from the primary transfer member 212*a* to the electrophotographic photoreceptor 207 during the transfer of the toner image formed on the electrophotographic photoreceptor 207 to the primary transfer member 212*a* can reduce the variation of the transfer electric current due to the type and material of the transfer receiving body 500, which allows the accurate control of the electric charge amount flowing into the electrophotographic photoreceptor 207. As a result, upgrading of image quality and reduction of environmental loads can be achieved at a higher level.

Figure 10:
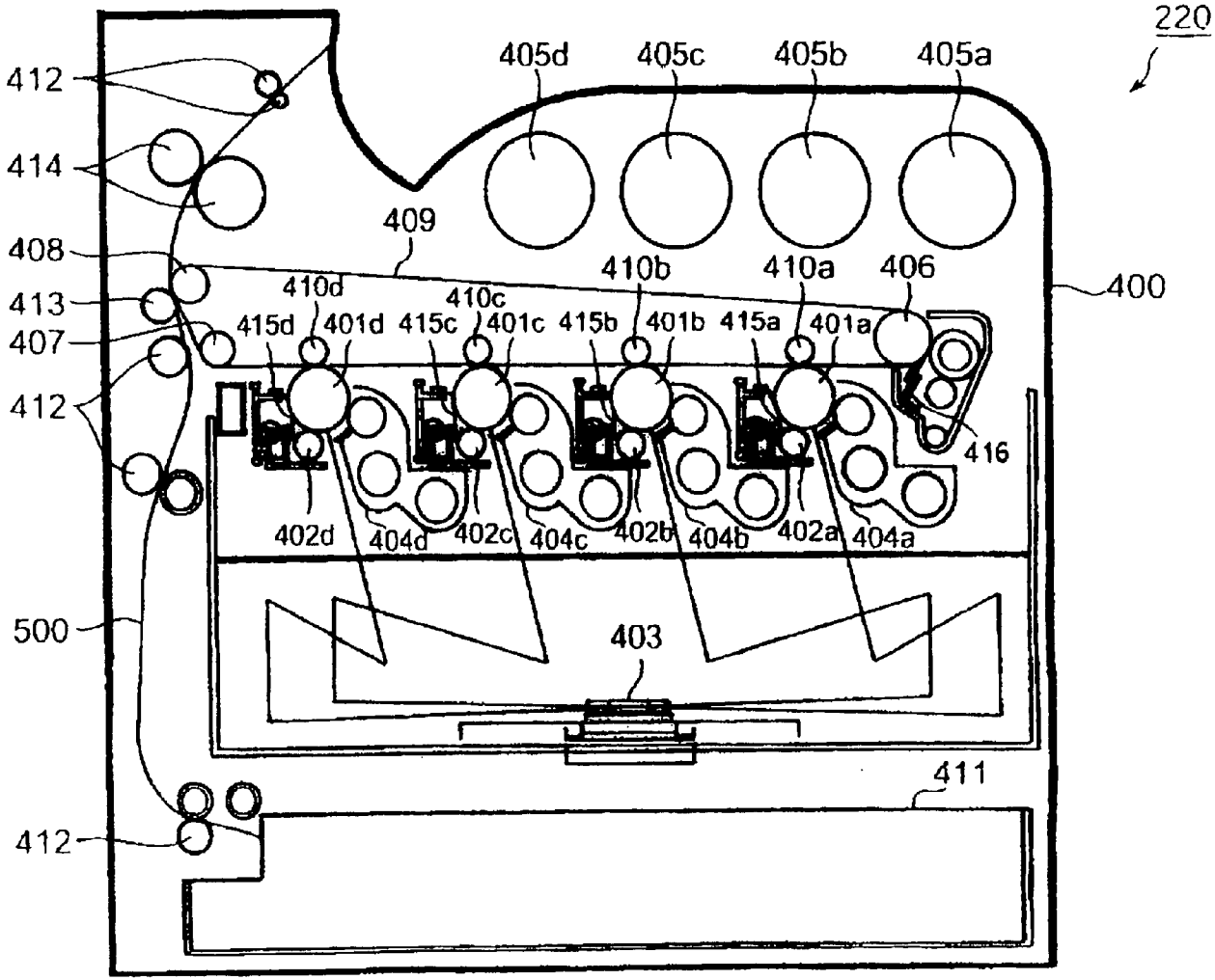
FIG. 10 is a schematic sectional view showing an image forming apparatus according to another exemplary embodiment of the invention.

FIG. 10 is a sectional view schematically showing the basic configuration of an image forming apparatus according to the third embodiment of the invention. As shown in FIG. 10, an image forming apparatus 220 is an image forming apparatus of the intermediate transfer system, and four electrophotographic photoreceptors 401*a* to 401*d* (for example, the electrophotographic photoreceptors 401*a*, 401*b*, 401*c*, and 401*d* are each capable of forming an image composed of yellow, magenta, cyan, and black color, respectively) are disposed in parallel along an intermediate transfer belt 409 inside a housing 400.

In this configuration, the electrophotographic photoreceptors 401*a* to 401*d* mounted on the image forming apparatus 220 are each preferably an electrophotographic photoreceptor having a photosensitive layer containing hydroxygallium phthalocyanine.

The electrophotographic photoreceptors 401*a* to 401*d* are each rotatable in the predetermined direction (counterclockwise direction on a paper sheet), and along the rotation direction, charging rolls 402*a* to 402*d*, developing devices 404*a* to 404*d*, primary transferring rolls 410*a* to 410*d*, and cleaning blades 415*a* to 415*d* are disposed. Four color toners: black, yellow, magenta, and cyan each held in the toner cartridges 405*a* to 405*d* can be loaded in the developing devices 404*a* to 404*d*. These toners satisfy the condition that the average shape factor is 100 to 140. Furthermore, the primary transferring rolls 410*a* to 410*d* are each in contact with the electrophotographic photoreceptors 401*a* to 401*d* through the intermediate transfer belt 409.

Furthermore, a laser beam source (exposure device) 403 is disposed at a predetermined position inside the housing 400, and the device is capable of irradiating the surface of the charged electrophotographic photoreceptors 401*a* to 401*d* with laser beam emitted from the laser beam source 403. Thus, the electrophotographic photoreceptors 401*a* to 401*d* are sequentially subjected to the charging, exposure, development, primary transfer, and cleaning processes during rotation, and then the toner images of each color are transferred to and superimposed on the intermediate transfer belt 409. In this instance, by combining the electrophotographic photoreceptors 401*a* to 401*d* comprising the photosensitive layer containing the specific hydroxygallium phthalocyanine with the charging device in the invention, the upgrading of image quality and the reduction of environmental loads are achieved at a higher level even with a tandem-type color image forming apparatus.

The intermediate transfer belt 409 is supported by a driving roll 406, a backup roll 408, and a tension roll 407 with a predetermined tension, and the rolls allows the belt to rotate with no deflection. Furthermore, a secondary transferring roll 413 is disposed being abutted against the backup roll 408 through the intermediate transfer belt 409. The intermediate transfer belt 409 having passed between the backup roll 408 and the secondary transferring roll 413 is cleaned with, for example, a cleaning blade 416 disposed in the vicinity of the driving roll 406, and then reused in the next image forming process.

A tray (tray for the transfer receiving body) 411 is disposed in the prescribed position inside the housing 400, and a transfer receiving body 500 (such as paper) contained in the tray 411 is transferred between the intermediate transfer belt 409 and the secondary transfer roll 413 and between two fixing rolls 414 in contact with each other by transferring rolls 412, and then delivered outside the housing 400.

As described above, the intermediate transfer belt 409 is used as the intermediate transfer body. The intermediate transfer body may be in a belt form as in the intermediate transfer belt 409, or in a drum form. As the resin material used as the substrate of the intermediate transfer body in the belt form, conventionally known resins may be used. Examples thereof include polyimide resin, polycarbonate resin (PC), polyvinylidene fluoride (PVDF), polyalkylene terephthalate (PAT), blend materials such as ethylene tetrafluoroethylene copolymer (ETFE)/PC, ETFE/PAT, and PC/PAT, resin materials such as polyester, polyether ether ketone, and polyamide, and resin materials mainly composed of these materials. Furthermore, the resin materials may be blended with elastic materials.

As the elastic material, polyurethane, chlorinated polyisoprene, NBR, chloropyrene rubber, EPDM, hydrogenated polybutadiene, butyl rubber, silicone rubber and the like may be used alone or as a blend of more than two components. To these resin materials or elastic materials for use in the substrate, as necessary, an electro-conductive agent imparting electron conductivity or an electro-conductive agent having ion conductivity is added alone or in combination of two or more kinds thereof. Among these, a polyimide resin in which an electro-conductive agent has been dispersed is preferable because it has excellent mechanical strength. As the electro-conductive agent, electro-conductive polymers such as carbon black, metal oxide, and polyaniline may be used.

When an intermediate transfer body in belt form such as the intermediate transfer belt 409 is used, in general, the thickness of the belt is preferably 50 to 500 μm, more preferably 60 to 150 μm. However, the thickness can be appropriately selected depending on hardness of the material.

For example, a belt composed of a polyimide resin in which an electro-conductive agent has been dispersed can be produced as described in JP-A No. 63-311263; 5 to 20% by weight of carbon black as an electro-conductive agent is dispersed in a solution of polyamide acid, which is a polyimide precursor, the dispersion solution is spread over a metal drum and dried thereon. Subsequently, the film detached from the drum is drawn at a high temperature to form a polyimide film, and the film is cut into an appropriate size to form endless belts.

The film is usually formed as follows: a film forming stock solution, which is composed of a polyamide acid solution in which an electro-conductive agent has been dispersed, is poured into a cylindrical-shaped mold, and, for example, formed into a film by centrifugal casting, while the cylindrical-shaped mold is rotated with a rotational speed of 500 to 2,000 rpm during heating at a temperature of 100 to 200° C. Subsequently, the obtained film is removed from the mold in a semi-cured state and laid over an iron core, and completely cured by proceeding a polyimidation (ring closure reaction of polyamide acid) at a high temperature of 300° C. or higher. Alternatively, the polyimide film may be formed by spreading the film-forming stock solution over a metal sheet in a uniform thickness, and heating at 100 to 200° C. in the same manner as the above-described method to remove the major part of the solvent, followed by gradually increasing the temperature to 300° C. or higher. Furthermore, the intermediate transfer body may have a surface layer.

When an intermediate transfer body in drum form is used, the substrate is preferably a cylindrical substrate composed of aluminum, stainless steel (SUS), copper or the like. As necessary, the cylindrical substrate may be coated with an elastic layer, and a surface layer may be formed on the elastic layer.

Figure 11:
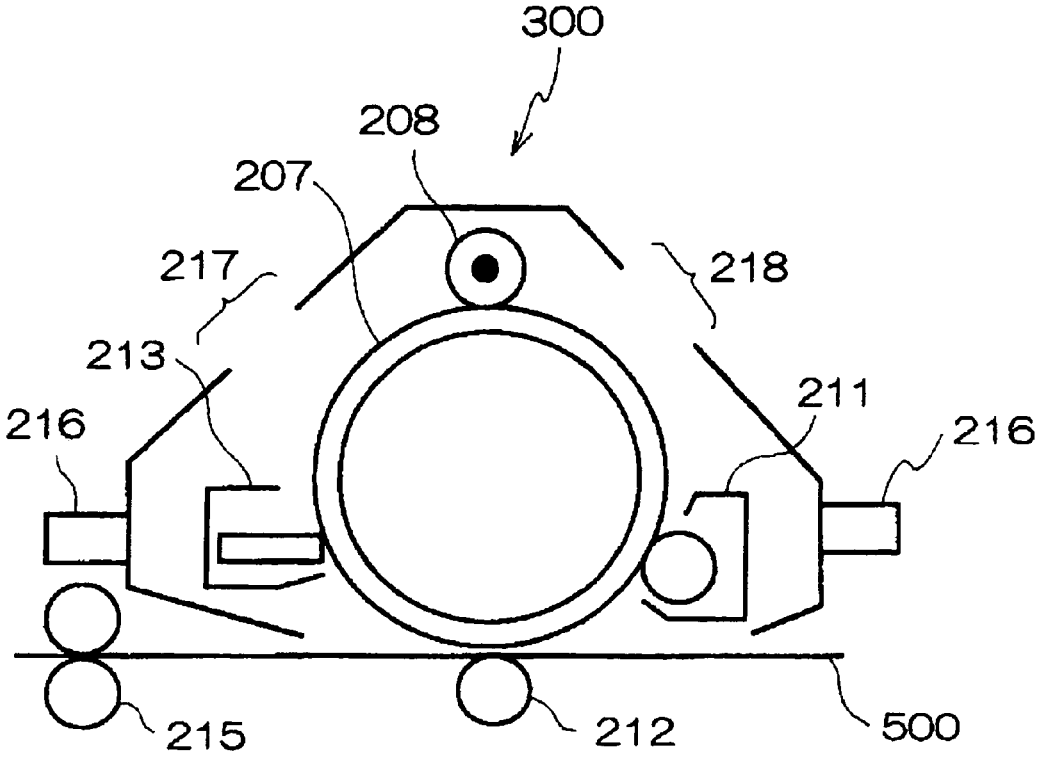
FIG. 11 is a schematic block diagram showing a process cartridge according to an exemplary embodiment of the invention.

FIG. 11 is a sectional view schematically showing an embodiment of the process cartridge in the invention. In a process cartridge 300, an electrophotographic photoreceptor 207 is combined and integrated with a charging device 208, a developing device 211, a cleaning device 213, an opening 218 for exposure, and an opening 217 for erasing and exposure, using an attaching rail 216. The electrophotographic photoreceptor 207 preferably has a photosensitive layer containing hydroxygallium phthalocyanine. Furthermore, the developing device 211 supplies toner to the electrophotographic photoreceptor 207.

The process cartridge 300 is removable from the main body of the image forming apparatus comprising a transferring device 212, a fixing device 215, and other constituents not shown, and composes the image forming apparatus together with the main body of the image forming apparatus.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

The invention will be specifically described with reference to the following examples, however the invention is not limited to these examples.

EXAMPLE 1

(Manufacturing of Charging Roll)

—Formation of Elastic Layer—

A mixture of the following composition is kneaded by an open roll mill. The mixture prepared is applied onto an adhesive layer composed of a polyolefin-based adhesive (trade name: XJ150: manufactured by Lord Far East Incorporated) on the surface of an electro-conductive support having a diameter of 9 mm and formed by SU303 stainless steel, and an elastic layer is formed with a press-molding machine in the shape of a roll having a diameter of 15 mm, and thereafter, the elastic layer is ground. Thus, an electro-conductive elastic roll A having a diameter of 14 mm is obtained.

Rubber material 100 parts by weight (Epichlorohydrin-ethylene oxide-allylglycidyl ether copolymer rubber, trade name: Gechron 3106: manufactured by Zeon Corporation)

Electro-conductive agent (carbon black, trade name: Asahi Thermal: manufactured by Asahi Carbon Co., Ltd.) 15 parts by weight Electro-conductive agent (trade name: Ketjen Black EC: manufactured by Lion Corp.) 5 parts by weight Ionic electro-conductive agent (lithium perchlorate) 1 part by weight Vulcanizing agent (sulfur, 200 mesh: manufactured by Tsurumi Kagaku Kogyo) 1 parts by weight Vulcanization accelerator (trade name: Nocceler DM: manufactured by Ouchi Shinko Chemical Industrial CO., LTD.) 2.0 parts by weight Vulcanization accelerator (trade name: Nocceler TT: manufactured by Ouchi Shinko Chemical Industrial CO., LTD.) 0.5 parts by weight Vulcanization accelerator (zinc oxide, trade name: Zinc Oxide Type 1: manufactured by Seido Chemical Industry Co., Ltd.) 3 parts by weight Stearic acid 1.5 parts by weight —Formation of Surface Layer—

A dispersion solution A obtained by dispersing the mixture of the following composition with a beads mill is diluted with MEK and applied by dip coating onto the surface of the above-described electro-conductive elastic roll A, and thereafter, is heated and dried at 180° C. for 30 minutes, thereby a surface layer having a thickness of 7 μm is formed. Thus, the charging roll 1 is obtained.

Polymer material 100 parts by weight (Saturated copolymerized polyester resin solution, trade name: Vylon 30SS: manufactured by Toyobo Co., Ltd.)

Curing agent 26.3 parts by weight (Amino resin solution, trade name: Super BeckaminG-821-60: manufactured by Dainippon Ink And Chemicals, Incorporated)

Electro-conductive agent 10 parts by weight (Carbon black, trade name: MONARCH 1000: manufactured by Cabot Corporation)

—Manufacturing of Photoreceptor—

60 parts by weight of zinc oxide (prototype manufactured by Tayca Corporation, specific surface area: 16 $m^2/g$, average particle diameter: 70 nm) which has been surface-treated with a silane coupling agent (trade name: KBM603: manufactured by Shin-Etsu Chemical Co., Ltd.), 15 parts by weight of a curing agent (blocked isocyanate, trade name: Sumidur 3175: manufactured by Sumitomo Bayer Urethane Co., Ltd.), and 6 parts by weight of butyral resin(trade name: BM-1: manufactured by Sekisui Chemical Co., Ltd.) are dissolved in 60 parts by weight of methyl ethyl ketone, and dispersed for 2 hours in a sand mill together with glass beads having a diameter of 1 mm, thereby a dispersion solution is obtained. 0.005 parts by weight of dioctyl tin dilaurate as a catalyst is added to the obtained dispersion solution, thereby a coating solution for the undercoat layer is obtained. The thus obtained coating solution is applied by dip coating onto an aluminum substrate having a diameter of 30 mm, a length of 251 mm, and a thickness of 1 mm, dried at 160° C. for 100 minutes, thereby a the undercoat layer having a thickness 20 μm is obtained.

Figure 12:
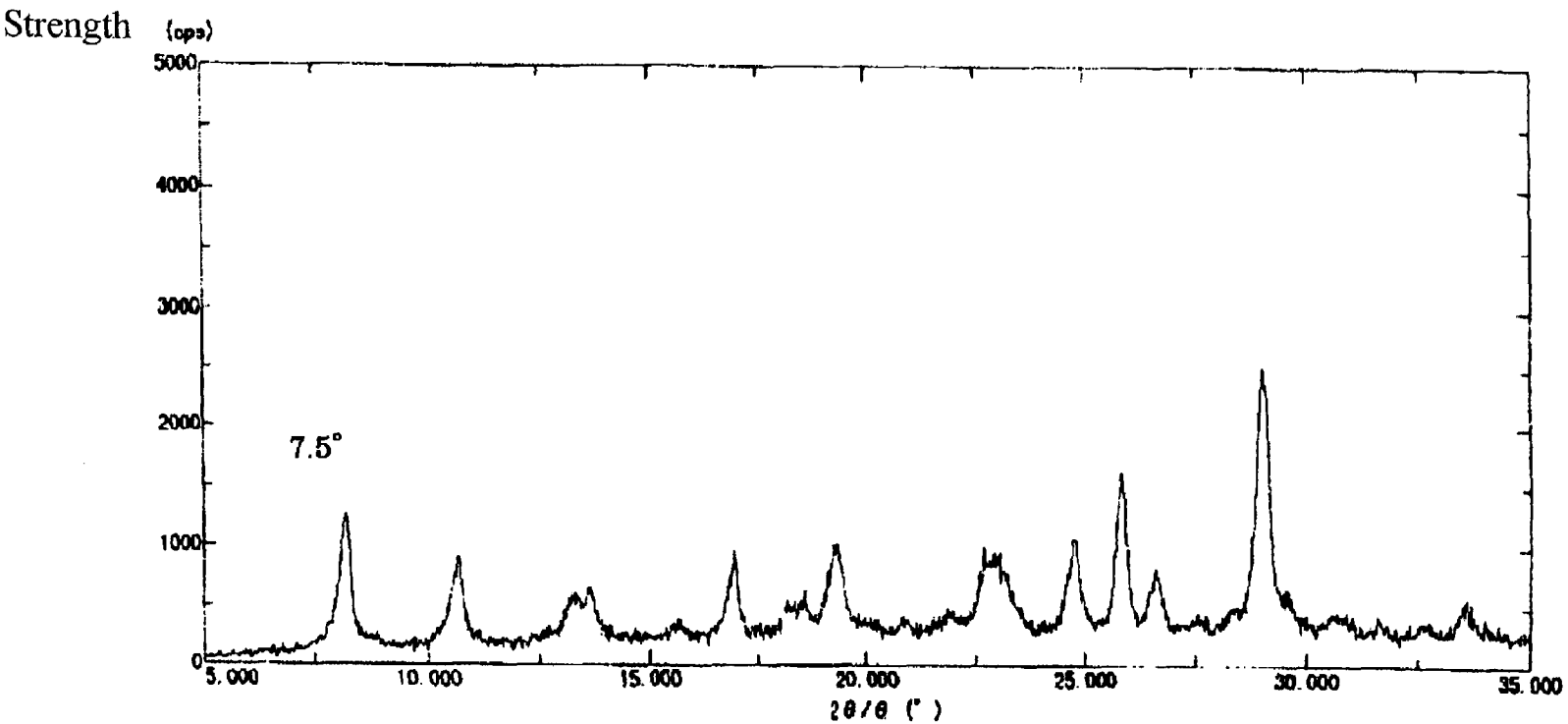
FIG. 12 is a graph showing an X ray diffraction spectrum of hydroxygallium phthalocyanine used in Examples 1 to 9 and Comparative Examples 1 to 3.

1 part by weight of Type 1 hydroxygallium phthalocyanine is ground into particles by a wet process, together with 20 parts by weight of N,N-dimethylformamide and 50 parts by weight of spherical glass media having a diameter of 1.2 mm, in a glass ball mill at 20° C. for 80 hours, subsequently washed with acetone, and dried. Thus 0.9 parts by weight of a hydroxygallium phthalocyanine pigment having diffraction peaks at Bragg angles (2θ±0.2°) of 7.5° and 28.3° in an X ray diffraction spectrum using a CuKα characteristic X ray. FIG. 12 shows a X ray diffraction spectrum of the hydroxygallium phthalocyanine. A mixture of 18 parts by weight of the hydroxygallium phthalocyanine, 16 parts by weight of vinyl chloride-vinyl acetate copolymer resin (trade name: VMCH: manufactured by Nippon Unicar Co., Ltd.) as a binding resin, and 100 parts by weight of n-butyl acetate is put in a 100-mL glass bottle together with glass beads having a diameter of 1.0 mm at a packing rate of 50%, and dispersed using a paint shaker for 1.5 hours. Thus a coating solution for electric charge generating layer is obtained. The thus obtained coating solution is applied to the undercoat layer by dip coating, and dried at 100° C. for 5 minutes to form an electric charge generating layer having a film thickness of 0.15 μm.

Furthermore, 4 parts by weight of N,-N'-diphenyl-N,N'-bis (3-methylphenyl)-[1,1']biphenyl-4,4'-diamine and 6 parts by weight of bisphenol Z polycarbonate resin (viscosity average molecular weight: 40,000) are dissolved in 60 parts by weight of tetrahydrofuran to obtain a coating solution, and the coating solution is applied to the electric charge generating layer, and dried at 150° C. for 30 minutes. Thus an electric charge transporting layer having a film thickness of 17 μm is formed, and the photoreceptor 1 is obtained.

(Evaluation)

The charging roll 1 and photoreceptor 1 are mounted on a drum cartridge of a color copying machine (trade name: DocuCentre Color a450: manufactured by Fuji Xerox Co., Ltd.), and a 50% half tone image is printed using a DocuCentre Color a450, which has been modified in such a manner that a voltage can be applied to the charging roll from outside, under conditions of low temperature and humidity (10° C., 15% RH) and high temperature and humidity (28° C., 85% RH). The image quality (initial image quality) is evaluated on the basis of the number of developed white spots. The conditions for the direct current voltage and the alternating current frequency are in accordance with the setting of the copying machine.

A: 0 to 10 white spots on a A4 sheet.

B: 11 to 30 white spots on a A4 sheet.

C: 31 to 50 white spots on a A4 sheet.

D: 51 or more white spots on a A4 sheet.

Subsequently, a printing test is carried out on 50,000 sheets of A4 size paper (25,000 sheets are printed under conditions of 10° C. and 15% RH, and thereafter, 25,000 sheets are printed under conditions of 28° C. and 85% RH), and the image quality durability (image quality after 50,000 sheets are printed) is evaluated. After the image quality durability is evaluated, the amount of wear on the image supporter is measured using an eddy-current coating thickness gauge. The results of the evaluation of the image quality are summarized in Table 2. The obtained results are summarized in Table 2 together with the fluctuation of the outside diameter, resistance, resistance variation, 10-point average roughness (Rz), dynamic ultra-microhardness and Iac/I(inflection) of the charging roll.

EXAMPLE 2

(Manufacturing of Charging Roll)

—Formation of Elastic Layer—

An electro-conductive elastic roll B is molded as in Example 1, except that conditions for grinding and the fluctuation of the outside diameter are changed.

—Formation of Surface Layer—

A surface layer is formed and a charging roll 2 is obtained as in Example 1, except that an electro-conductive elastic roll B is used.

(Manufacturing of Photoreceptor)

A photosensitive layer is formed and a photoreceptor 2 is obtained as in Example 1.

(Evaluation)

The photoreceptor 2 is evaluated as in Example 1. The results are summarized in Table 2.

EXAMPLE 3

(Manufacturing of Charging Roll)

—Formation of Elastic Layer—

An electro-conductive elastic roll C is molded as in Example 1, except that conditions for grinding and the fluctuation of the outside diameter are changed.

—Formation of Surface Layer—

A surface layer is formed and a charging roll 3 is obtained as in Example 1, except that an electro-conductive elastic roll C is used.

(Manufacturing of Photoreceptor)

A photosensitive layer is formed and a photoreceptor 3 is obtained as in Example 1.

(Evaluation)

The photoreceptor 3 is evaluated as in Example 1. The results are summarized in Table 2.

EXAMPLE 4

(Manufacturing of Charging Roll)

—Formation of Elastic Layer—

An electro-conductive elastic roll A is molded as in Example 1.

—Formation of Surface Layer—

A surface layer is formed and a charging roll 4 is obtained as in Example 1, except that the amount of the electro-conductive agent on the surface layer is decreased from 10 parts by weight to 5 parts by weight.

(Manufacturing of Photoreceptor)

A photosensitive layer is formed and a photoreceptor 4 is obtained as in Example 1.

(Evaluation)

The photoreceptor 4 is evaluated as in Example 1. The results are summarized in Table 2.

EXAMPLE 5

(Manufacturing of Charging Roll)

—Formation of Elastic Layer—

An electro-conductive elastic roll A is molded as in Example 1.

—Formation of Surface Layer—

A surface layer is formed and a charging roll 5 is obtained as in Example 1, except that the amount of the electro-conductive agent on the surface layer is increased from 10 parts by weight to 13 parts by weight.

(Manufacturing of Photoreceptor)

A photosensitive layer is formed and a photoreceptor 5 is obtained as in Example 1.

(Evaluation)

The photoreceptor 5 is evaluated as in Example 1. The results are summarized in Table 2.

EXAMPLE 6

(Manufacturing of Charging Roll)

—Formation of Elastic Layer—

An electro-conductive elastic roll D is molded as in Example 1, except that the electro-conductive agent is changed as described below.

| | |
|---|---|
| Electro-conductive agent (carbon black, trade name: Asahi Thermal: manufactured by Asahi Carbon Co., Ltd.) | 5 parts by weight |
| Electro-conductive agent (trade name: Ketjen Black EC: manufactured by Lion Corp.) | 8 parts by weight |

—Formation of Surface Layer—

A surface layer is formed and a charging roll 6 is obtained as in Example 1, except that an electro-conductive elastic roll D is used.

(Manufacturing of Photoreceptor)

A photosensitive layer is formed and a photoreceptor 6 is obtained as in Example 1.

(Evaluation)

The photoreceptor 6 is evaluated as in Example 1. The results are summarized in Table 3.

EXAMPLES 7 TO 9

(Manufacturing of Charging Roll)

Charging rolls 7 to 9 are obtained as in Example 1.

(Manufacturing of Photoreceptor)

Photosensitive layers are formed and photoreceptors 7 to 9 are obtained as in Example 1.

(Evaluation)

The photoreceptors 7 to 9 are evaluated as in Example 1, except for Iac/I(inflection). The results are summarized in Table 3.

COMPARATIVE EXAMPLE 1

(Manufacturing of Charging Roll)

—Formation of Elastic Layer—

An electro-conductive elastic roll E is molded as in Example 1, except that conditions for grinding and the fluctuation of the outside diameter are changed.

—Formation of Surface Layer—

A surface layer is formed and a charging roll 10 is obtained as in Example 1, except that an electro-conductive elastic roll E is used.

(Manufacturing of Photoreceptor)

A photosensitive layer is formed and a photoreceptor 10 is obtained as in Example 1.

(Evaluation)

The photoreceptor 10 is evaluated as in Example 1. The results are summarized in Table 4.

COMPARATIVE EXAMPLE 2

(Manufacturing of Charging Roll)

—Formation of Elastic Layer—

An electro-conductive elastic roll A is molded as in Example 1.

—Formation of Surface Layer—

A surface layer is formed and a charging roll 11 is obtained as in Example 1, except that the amount of the electro-conductive agent on the surface layer is decreased from 10 parts by weight to 3 parts by weight.

(Manufacturing of Photoreceptor)

A photosensitive layer is formed and a photoreceptor 11 is obtained as in Example 1.

(Evaluation)

The photoreceptor 11 is evaluated as in Example 1. The results are summarized in Table 4.

COMPARATIVE EXAMPLE 3

(Manufacturing of Charging Roll)

—Formation of Elastic Layer—

An electro-conductive elastic roll F is molded as in Example 1, except that the electro-conductive agent is changed as described below.

| | |
|---|---|
| Electro-conductive agent (carbon black, trade name: Asahi Thermal: manufactured by Asahi Carbon Co., Ltd.) | 2 parts by weight |
| Electro-conductive agent (trade name: Ketjen Black EC: manufactured by Lion Corp.) | 8 parts by weight |
| Ionic electro-conductive agent (lithium perchlorate) | 0 part by weight |

—Formation of Surface Layer—

A surface layer is formed and a charging roll 12 is obtained as in Example 1, except that an electro-conductive elastic roll F is used.

(Manufacturing of Photoreceptor)

A photosensitive layer is formed and a photoreceptor 12 is obtained as in Example 1.

(Evaluation)

The photoreceptor 12 is evaluated as in Example 1. The results are summarized in Table 4.

TABLE 2

| | | Example 1 | Example 2 | Example 3 | Example 4 | Example 5 |
|---|---|---|---|---|---|---|
| Charging roll | Fluctuation (mm) | 0.03 | 0.05 | 0.09 | 0.03 | 0.03 |
| | Resistance (log · Ω) | 7.4 | 7.4 | 7.4 | 8.6 | 6.2 |
| | Resistance variation (log · Ω) | 0.3 | 0.2 | 0.2 | 0.3 | 0.2 |
| 10-point average roughness (Rz) (μm) | | 1.2 | 1.2 | 1.2 | 1.1 | 1.3 |
| Dynamic ultra-microhardness | | 0.08 | 0.08 | 0.08 | 0.07 | 0.09 |
| Iac/I (inflection) | | 1.1 | 1.1 | 1.1 | 1.1 | 1.1 |
| Evaluation on actual machine | Initial image quality | A/A | A/A | B/A | A/A | A/A |
| | Low temperature and humidity/high temperature and humidity | | | | | |
| | Image quality after printing 50,000 sheets | A/A | B/A | C/B | B/B | A/A |
| | Low temperature and humidity/high temperature and humidity | | | | | |
| | Wear of photoreceptor (μm) | 4.2 | 4.8 | 4.7 | 4.5 | 5.9 |

TABLE 3

| | | Example 6 | Example 7 | Example 8 | Example 9 |
|---|---|---|---|---|---|
| Charging roll | Fluctuation (mm) | 0.03 | 0.03 | 0.03 | 0.03 |
| | Resistance (log · Ω) | 7.4 | 7.4 | 7.4 | 7.4 |
| | Resistance variation (log · Ω) | 0.5 | 0.3 | 0.3 | 0.3 |
| 10-point average roughness (Rz) | | 1.4 | 1.2 | 1.2 | 1.2 |
| Dynamic ultra-microhardness | | 0.06 | 0.08 | 0.08 | 0.08 |
| Iac/I (inflection) | | 1.1 | 1.2 | 1.05 | 1.15 |
| Evaluation on actual machine | Initial image quality | B/A | A/A | A/A | A/A |
| | Low temperature and humidity/high temperature and humidity | | | | |
| | Image quality after printing 50,000 sheets | C/B | A/A | B/A | A/A |
| | Low temperature and humidity/high temperature and humidity | | | | |
| | Wear of photoreceptor (μm) | 4.6 | 6.0 | 4.1 | 4.4 |

TABLE 4

| | | Comparative Example 1 | Comparative Example 2 | Comparative Example 3 |
|---|---|---|---|---|
| Charging roll | Fluctuation (mm) | 0.12 | 0.03 | 0.03 |
| | Resistance (log · Ω) | 7.4 | 9.2 | 7.4 |
| | Resistance variation (log · Ω) | 0.3 | 0.5 | 1.0 |
| 10-point average roughness (Rz) | | 1.2 | 1.2 | 1.4 |
| Dynamic ultra-microhardness | | 0.08 | 0.07 | 0.06 |
| Iac/I (inflection) | | 1.2 | 1.1 | 1.1 |
| Evaluation on actual machine | Initial image quality | C/B | D/C | C/B |
| | Low temperature | | | |

TABLE 4-continued

| | Comparative Example 1 | Comparative Example 2 | Comparative Example 3 |
|---|---|---|---|
| and humidity/high temperature and humidity | | | |
| Image quality after printing 50,000 sheets Low temperature and humidity/high temperature and humidity | D/C | D/C | D/C |
| Wear of photoreceptor (μm) | 4.8 | 4.5 | 4.4 |

According to an aspect of the invention, an image forming apparatus which extends the operating life of the image forming apparatus by reducing charging stresses on the surface of an image supporter to reduce the wear of the image supporter, and develops less image quality defects resulting from local irregularity of charging by abnormal discharging can be provided.

All publications, patent applications, and technical standards mentioned in this specification are herein incorporated by reference to the same extent as if each individual publication, patent application, or technical standard was specifically and individually indicated to be incorporated by reference.

What is claimed is:

1. A charging device comprising a charging roll and a voltage application unit which is capable of applying to the charging roll a voltage in which an alternating current voltage is superimposed on a direct current voltage, the alternating current (Iac) which flows through the charging roll satisfying the following Equation (1), the charging roll satisfying the following conditions (a) to (c), and the charging roll contacting an image supporter to charge the image supporter:

$$Iac/I(\text{inflection}) \leqq 1.2 \qquad \text{Equation (1)}$$

(in the Equation (1), I (inflection) represents the flexion point of Iac)

(a) the fluctuation of the outside diameter is 0.1 mm or less (b) resistance (common logarithm) is 9.0 log·Ω or less (c) resistance variation (common logarithm) is 0.5 log·Ω or less.

2. The charging device of claim 1, wherein the voltage application unit comprises a power source, a detection unit which detects a voltage and/or an electric current applied to the charging roll by the power source, and a power control unit which controls the power source in such a manner that Equation (1) is satisfied on the basis of the voltage and/or electric current detected by the detection unit.

3. The charging device of claim 1, wherein the charging roll satisfies the following conditions (d) and (e):

(d) the surface has a 10-point average roughness (Rz) of 5 μm or less (e) the surface has a dynamic ultra-microhardness in the range of 0.04 to 0.5.

4. The charging device of claim 1, wherein the alternating current (Iac) which flows through the charging roll satisfies the following Equation (1'):

$$1.05 \leqq Iac/I(\text{inflection}) \leqq 1.15 \qquad \text{Equation (1')}.$$

5. The charging device of claim 1, wherein the resistance (common logarithm) of the charging roll is 6.0 log·Ω to 8.5 log·Ω.

6. The charging device of claim 1, wherein the resistance variation (common logarithm) of the charging roll is 0.3 log·Ω or less.

7. An image forming apparatus comprising an image supporter, a charging device which charges the image supporter, a latent image forming device which forms a latent image on the charged surface of the image supporter, a developing device which develops the latent image formed on the surface of the image supporter into a toner image with toner, a transferring device which transfers the toner image formed on the surface of the image supporter to a transfer receiving body, and a cleaning device which removes residual toner from the surface of the image supporter after transferring of the toner image, the charging device comprising a charging roll, a voltage application unit which is capable of applying to the charging roll a voltage in which an alternating current voltage is superimposed on a direct current voltage, the alternating current (Iac) which flows through the charging roll satisfying the following Equation (1), the charging roll satisfying the following conditions (a) to (c), and the charging roll contacting an image supporter to charge the image supporter:

$$Iac/I(\text{inflection}) \leqq 1.2 \qquad \text{Equation (1)}$$

(in the Equation (1), I (inflection) represents the flexion point of Iac)

(a) the fluctuation of the outside diameter is 0.1 mm or less (b) resistance (common logarithm) is 9.0 log·Ω or less (c) resistance variation (common logarithm) is 0.5 log·Ω or less.

8. The image forming apparatus of claim 7, wherein the voltage application unit comprises a power source, a detection unit which detects a voltage and/or an electric current applied to the charging roll by the power source, and a power control unit which controls the power source in such a manner that the Equation (1) is satisfied on the basis of the voltage and/or electric current detected by the detection unit.

9. The image forming apparatus of claim 7, wherein the charging roll satisfies the following conditions (d) and (e):

(d) the surface has a 10-point average roughness (Rz) of 5 μm or less (e) the surface has a dynamic ultra-microhardness in the range of 0.04 to 0.5.

10. The image forming apparatus of claim 7, wherein the alternating current (Iac), which flows through the charging roll, satisfies the following Equation (1'):

$$1.05 \leqq Iac/I(\text{inflection}) \leqq 1.15 \qquad \text{Equation (1')}.$$

11. The image forming apparatus of claim 7, wherein the resistance (common logarithm) of the charging roll is 6.0 log·Ω to 8.5 log·Ω.

12. The image forming apparatus of claim 7, wherein the resistance variation (common logarithm) of the charging roll is 0.3 log·Ω or less.

13. The image forming apparatus of claim 7, wherein the image supporter has an electro-conductive substrate and a photosensitive layer containing hydroxygallium phthalocyanine provided on the electro-conductive substrate.

14. The image forming apparatus of claim 7, wherein the hydroxygallium phthalocyanine has diffraction peaks at Bragg angles (2θ±0.2°) of 7.5° and 28.3° in an X ray diffraction spectrum using a CuKα characteristic X ray.

* * * * *